US006027094A

United States Patent [19]

Tian

[11] Patent Number: 6,027,094

[45] Date of Patent: Feb. 22, 2000

[54] SET OF PARTS FOR USE IN BUILDING AND A METHOD OF USING SAME

[76] Inventor: Khoo Tian, No 2 Jalan 2/109 Taman Desa, Selangor Darul Ehsan, Malaysia, 68000

[21] Appl. No.: 08/695,065

[22] Filed: Aug. 2, 1996

Related U.S. Application Data

[63] Continuation of application No. 08/262,816, Jun. 21, 1994, abandoned.

[30] Foreign Application Priority Data

Jun. 23, 1993 [MY] Malaysia ..... PI 930 1213

[51] Int. Cl.[7] ..... B28B 7/16

[52] U.S. Cl. ..... 249/186; 249/184; 249/142; 52/576

[58] Field of Search ..... 52/576, 125.4, 52/125.5, 577, 381, 382, 732.1, 732.2; 249/142, 152, 180, 184, 186

[56] References Cited

FOREIGN PATENT DOCUMENTS

| | | |
|---|---|---|
| 1070-011 | 1/1984 | U.S.S.R. . |
| 652575 | 4/1951 | United Kingdom . |
| 1096106 | 12/1967 | United Kingdom . |
| 1403985 | 8/1975 | United Kingdom . |
| 2135236 | 8/1984 | United Kingdom . |
| 2216058 | 10/1989 | United Kingdom . |

*Primary Examiner*—Carl D. Friedman
*Assistant Examiner*—Creighton Smith
*Attorney, Agent, or Firm*—Townsend and Townsend and Crew LLP

[57] ABSTRACT

The invention relates to a set of parts for use in building, comprising a plurality of separate parts which are assemblable to provide a former for defining a desired configuration in a set settable material, characterised by at least two interengageable surface forming parts (2, 3), and by a thrust part (4) which maintains the surface forming parts (2, 3) in an assembled position, and by the thrust part (4) being removable to allow the surface forming parts (2, 3) to be moved from the set settable material whereby to leave the desired configuration (7) in that material (6).

The invention also extends to a constructional method, and to a building or part thereof constructed using the set of parts described.

15 Claims, 33 Drawing Sheets

SET OF PARTS FOR USE IN BUILDING AND A METHOD OF USING SAME

This is a Continuation of U.S. application Ser. No. 08/262,816, filed Jun. 21, 1994, now abandoned the disclosure of which is incorporated by reference.

The invention relates to a set of parts for use in building, and a method of using same.

In building construction, it is often necessary to provide desired configurations in a concrete slab or a concrete wall, for example a cylinder or cylinders which extend(s) through the slab or the wall to provide a passage for essential surfaces such as electrical cabling. It is often necessary to disrupt work on the building whilst such passages are provided, for example by grinding out channels. This is time consuming and expensive per se, as well as potentially providing disruption for a building project overall.

It is accordingly an object of the invention to seek to mitigate these disadvantages.

According to a first aspect of the invention there is provided a set of parts for use in building, comprising a plurality of separate parts which are assemblable to provide a former for defining a desired configuration in a set settable material, there being at least two interengageable surface forming parts, and a thrust part which maintains the surface forming parts in an assembled position, the thrust part being removable to allow the surface forming parts to be moved from the set settable material whereby to leave the desired configuration in that material.

The surface forming parts may define a curved or angular outer surface when assembled.

The surface forming parts may define a geometric shape such as a circle in cross-section when assembled.

There may be four surface forming parts, two of which may form substantially a circle when assembled and which may have interengaging means for releasable interengagement with complementary interengagement means of the other two surface forming parts, and the two other surfaces may form parts being adapted to engage between facing edges of the assembled first two surface forming parts.

The complementary interengaging parts may comprise hook-like parts.

The first two forming parts may comprise adjacent a respective edge, a guide means.

The guide means may each comprise a further hook-like member which may be in an assembled set directed towards each other and which may terminate spaced from one another whereby to allow a guide for the thrust member.

The thrust member may comprise a cylinder adapted in the assembled set to seat on the hook-like members of the guide means and on a complementary surface of each of the other two surface forming parts.

The hook-like members of the guide members and the thrust member may have complementary curved surfaces.

The thrust member may comprise a frame which in the assembled set of parts may be located substantially cylindrically and which may have a plurality of arms two of which engage a respective one of the other two surface forming parts.

The two arms may comprise projecting spaced apart arm parts supporting at or adjacent one end an elongate nose member complementary in configuration to an opposed surface of the respective one of the other two surface forming parts, and at the other end being pivotably connected with the frame.

The frame may have four arms arranged in a cruciform configuration about a central elongate body, the other two arms being at or adjacent one end of the body and having at a free end thrust members for engaging the first two surface forming members.

The nose member may be pivotably connected with the arm parts at or adjacent a free end of the respective arm parts.

According to a second aspect of the invention there is provided a former, whenever assembled from a set of parts as hereinbefore defined.

According to a third aspect of the invention there is provided a method of construction comprising providing a former as hereinbefore defined at a desired location to provide a desired configuration in settable material used in construction of a building, providing flowable, settable material used in construction at or round the former, allowing the material to set, and then dismantling the former from the set settable material whereby to provide a desired configuration in that material.

The configuration may be a cylindrical bore in the set settable material; or it may comprise a groove in the set settable material.

The method may comprise constructing a floor slab or a wall panel, and there may be a plurality of bores along the length of an edge of the slab or along the height of the wall each formed by a respective former and extending thereinto.

There may be the step of mounting a scaffolding along the perimeter of the building by forming the edge bores system.

The scaffolding system may be a horizontal, in use, scaffolding system, suitably mounting a mobile carriage.

A set of parts embodying the invention, and a method of using same, are hereinafter described, by way of example, with reference to the accompanying drawings.

Figure 14A:
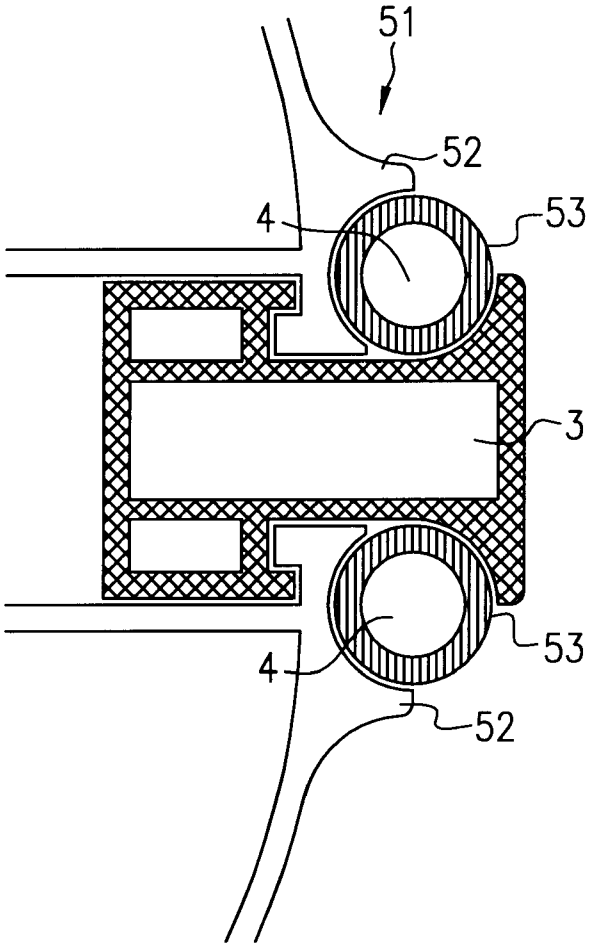
FIGS. 14 and 14A show a fourth embodiment of a set of parts according to the invention, FIG. 14A showing an enlarged part of FIG. 14.
Figure 14:
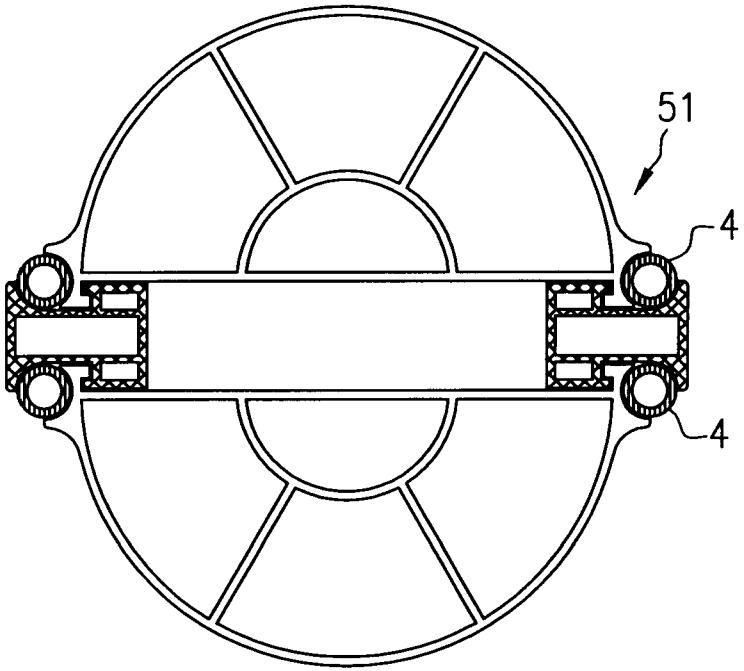
Figure 15A:
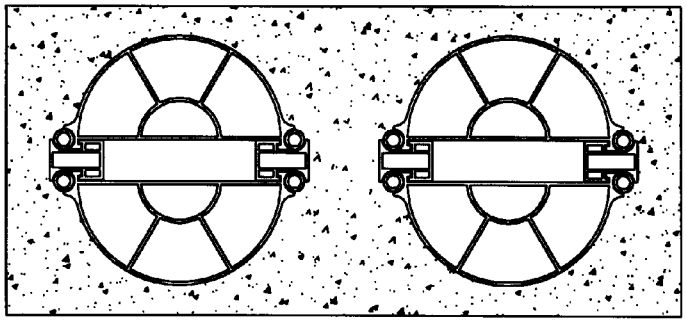
Figure 15B:
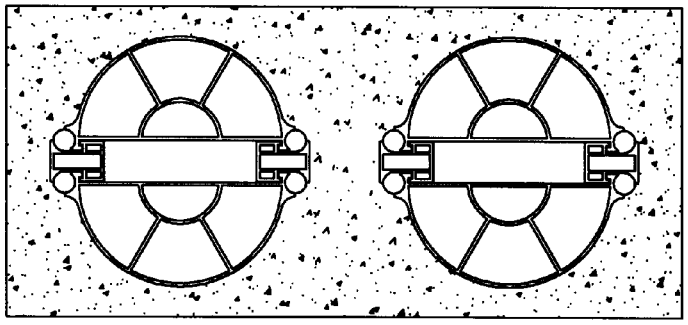
Figure 15C:
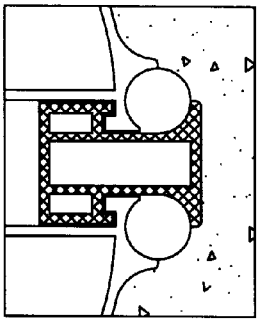
Figure 15D:
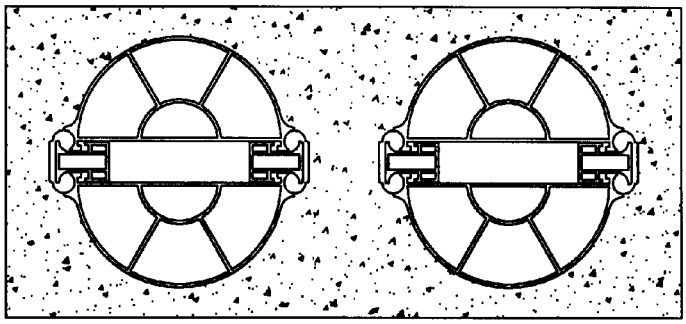
Figure 15E:
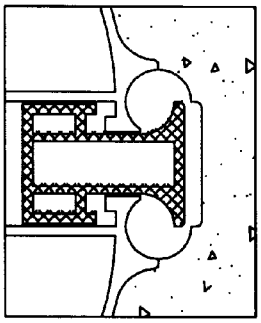
Figure 15F:
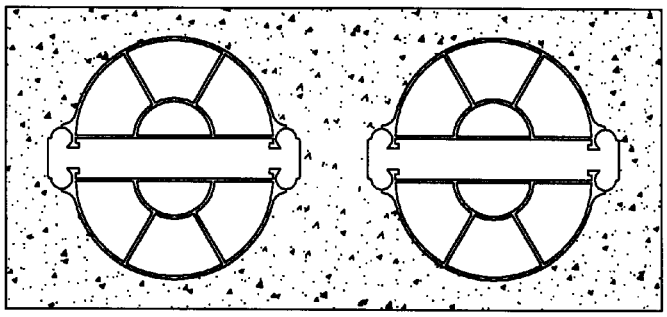
Figure 15G:
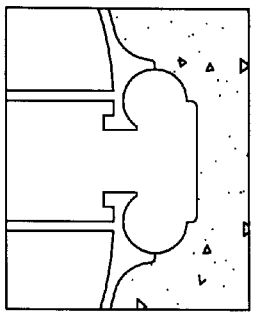
Figure 15H:
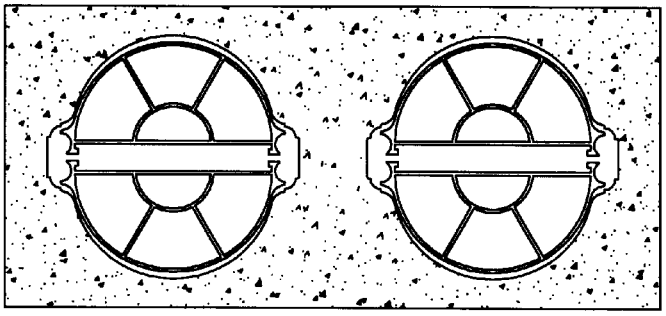
Figure 15I:
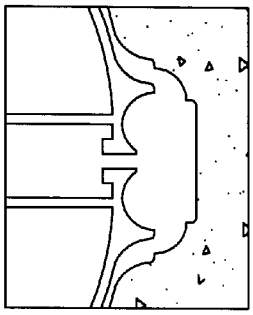
Figure 15J:
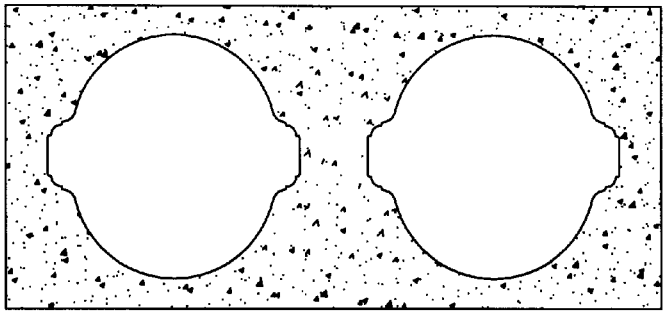
Figure 15K:
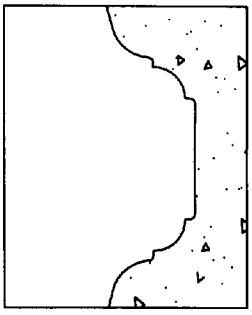
Figure 16:
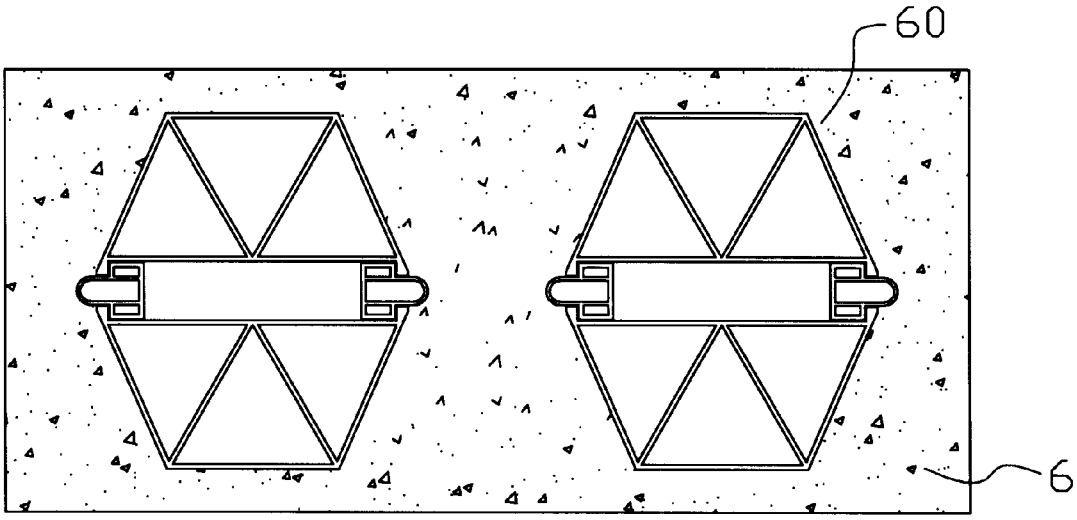
Figure 17:
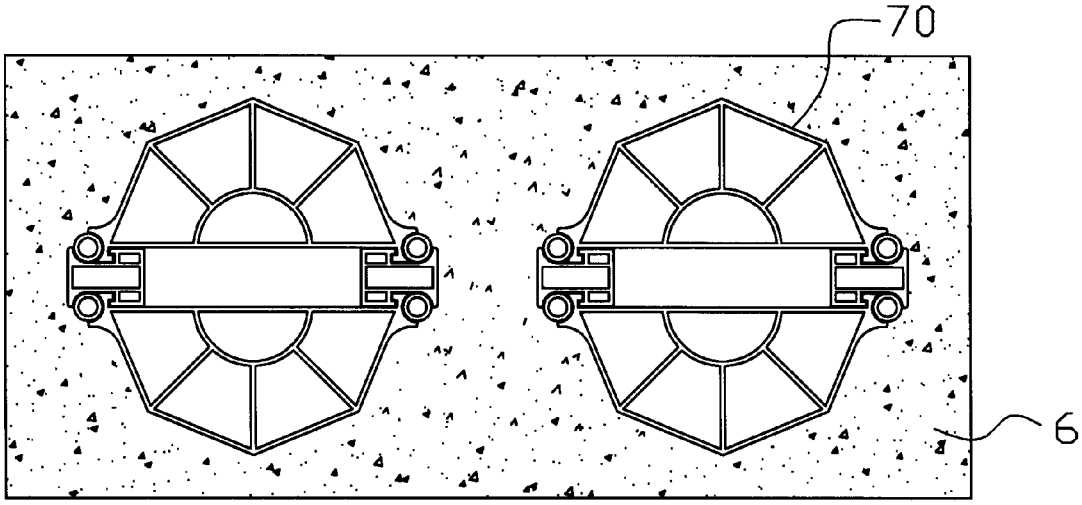
Figure 18:
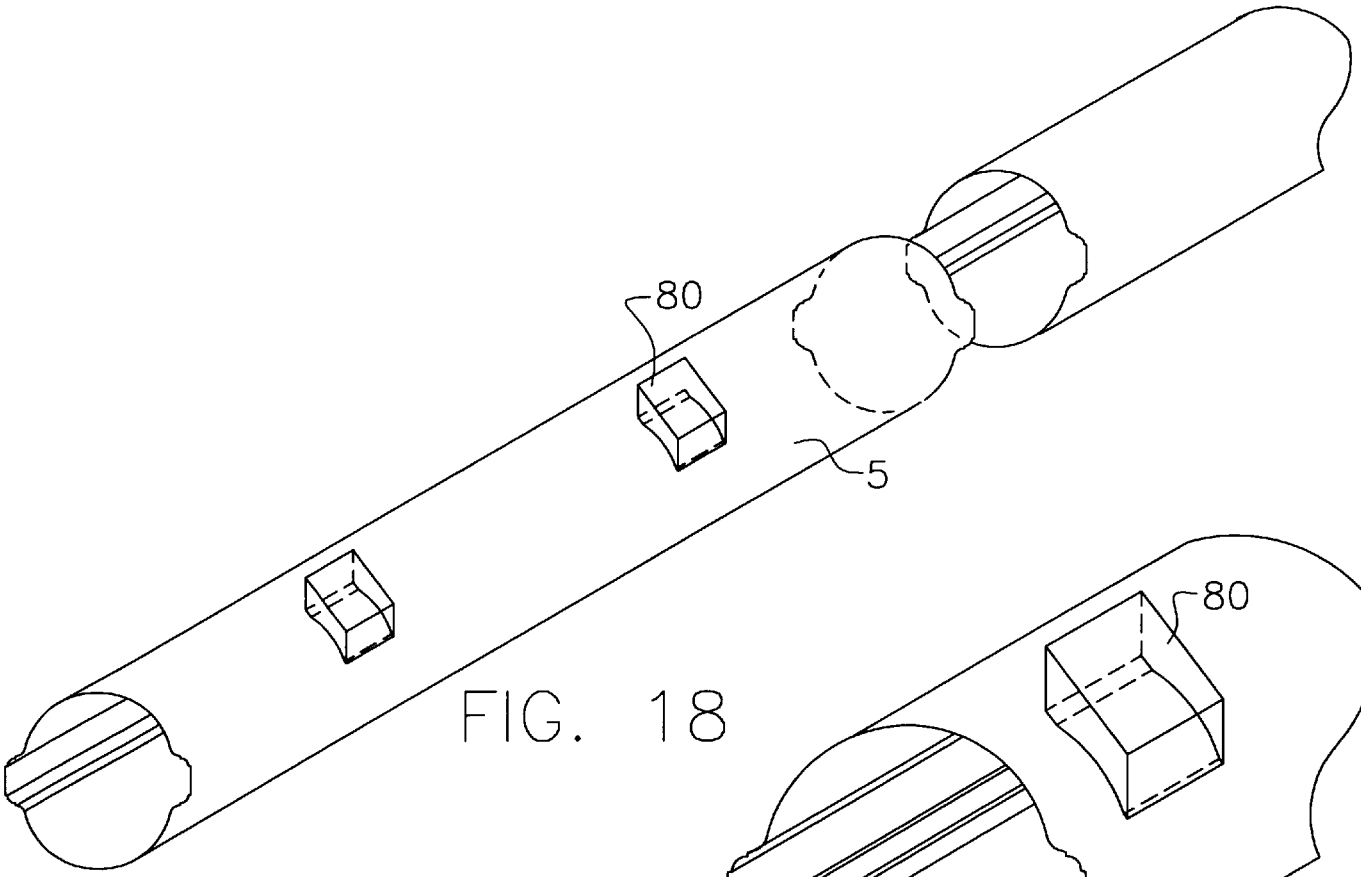
Figure 18A:
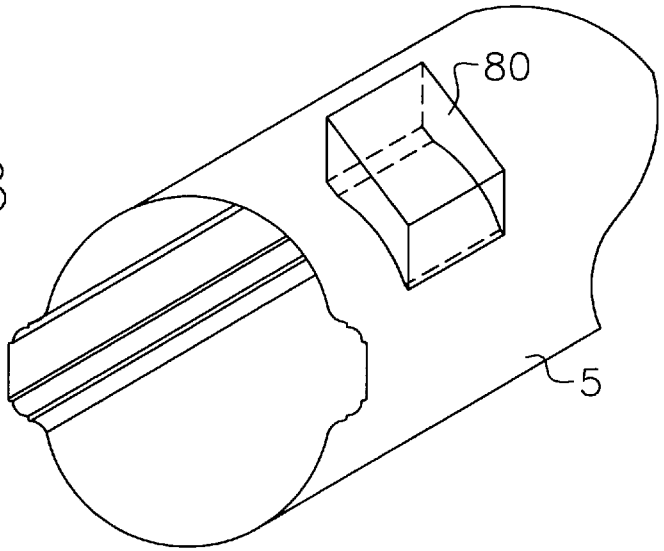
Figure 19:
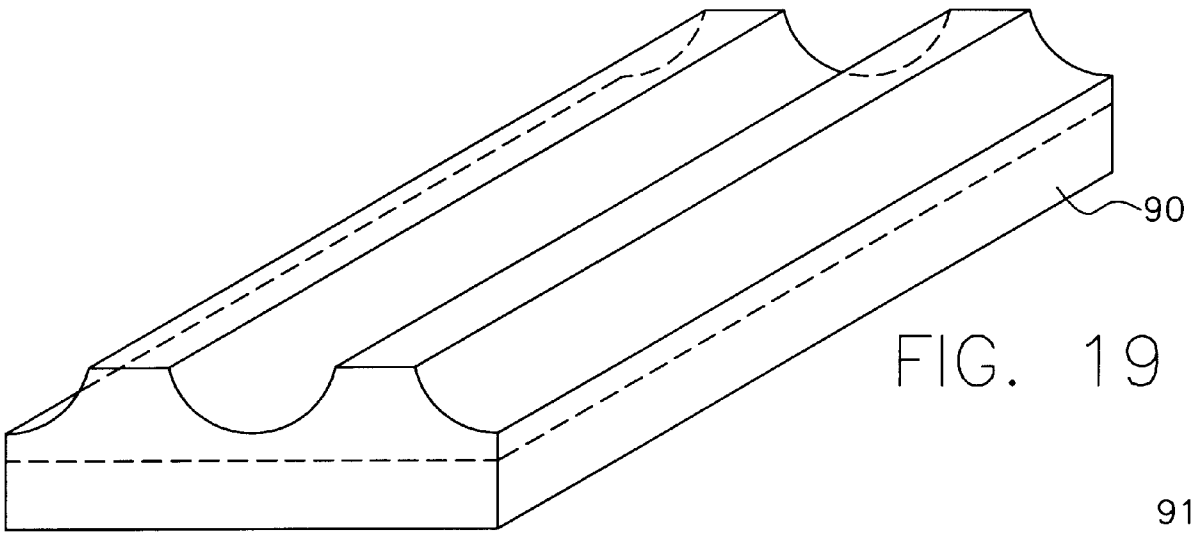
Figure 19A:
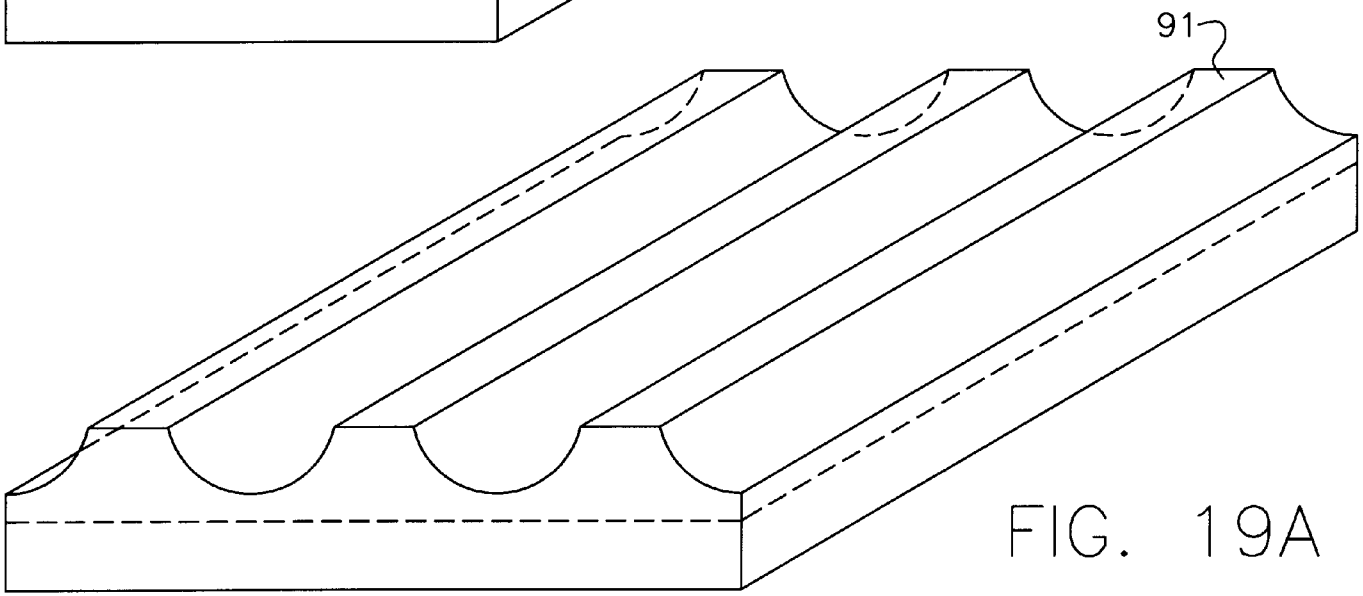
Figure 19B:
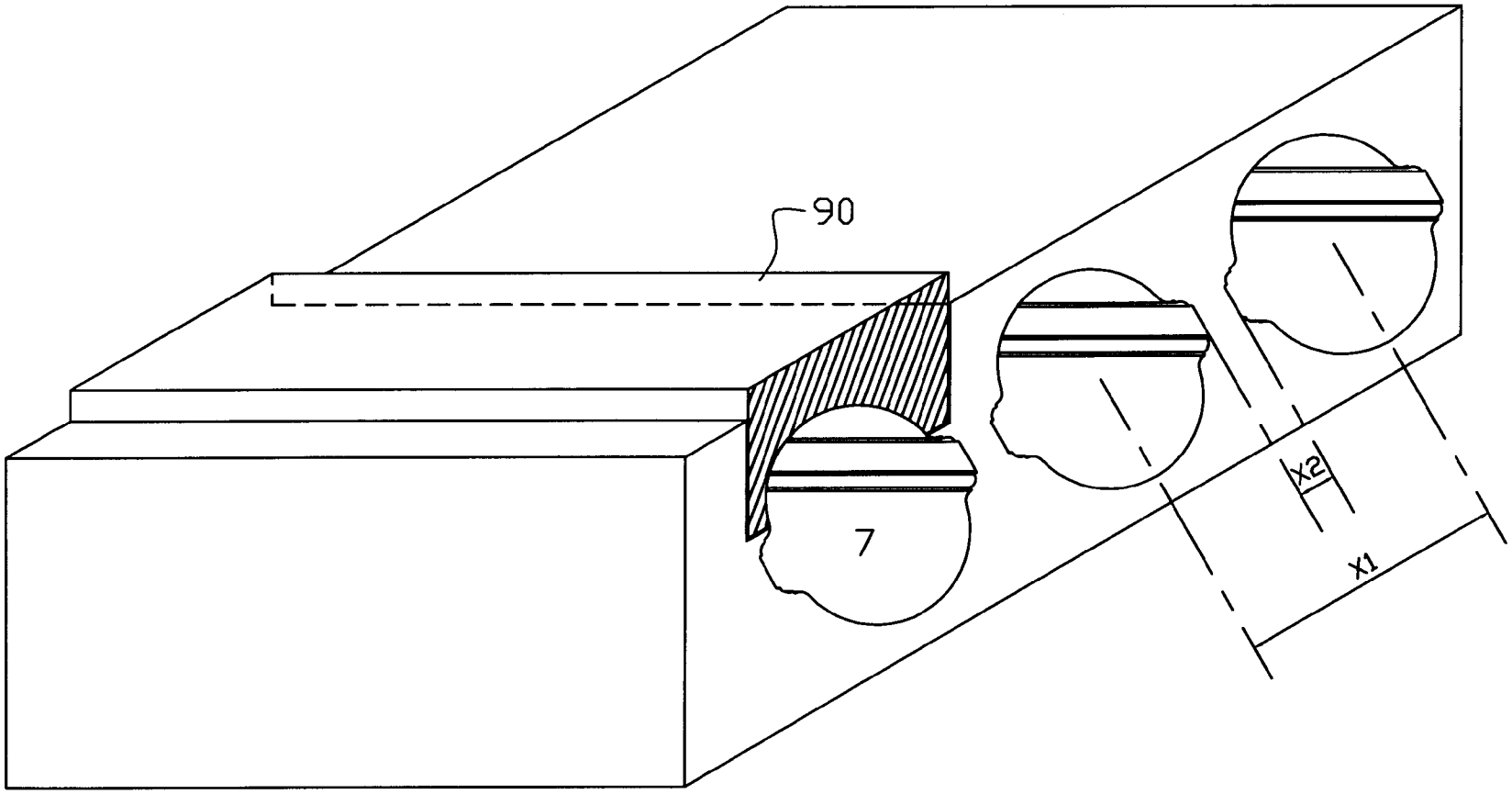
Figure 20A:
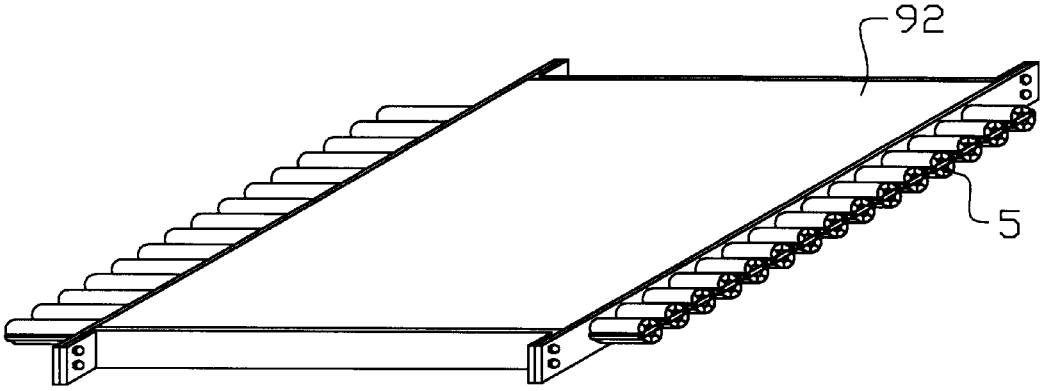
Figure 20B:
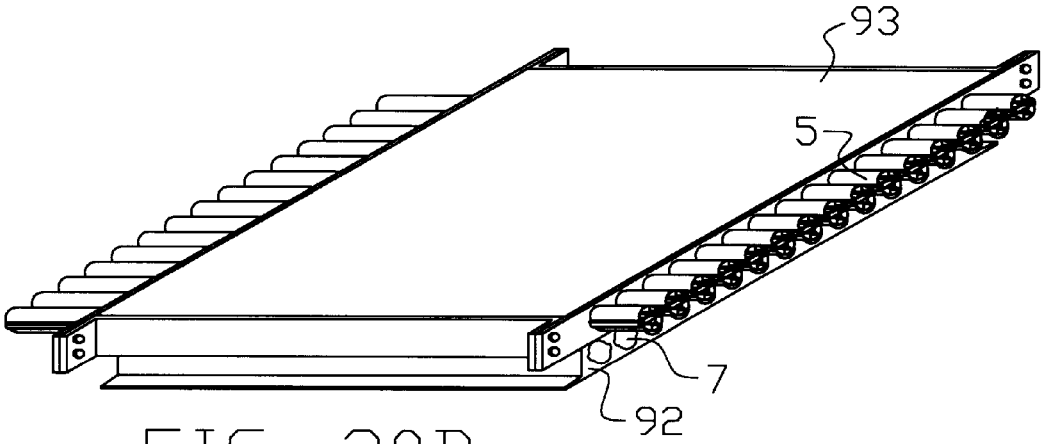
Figure 20C:
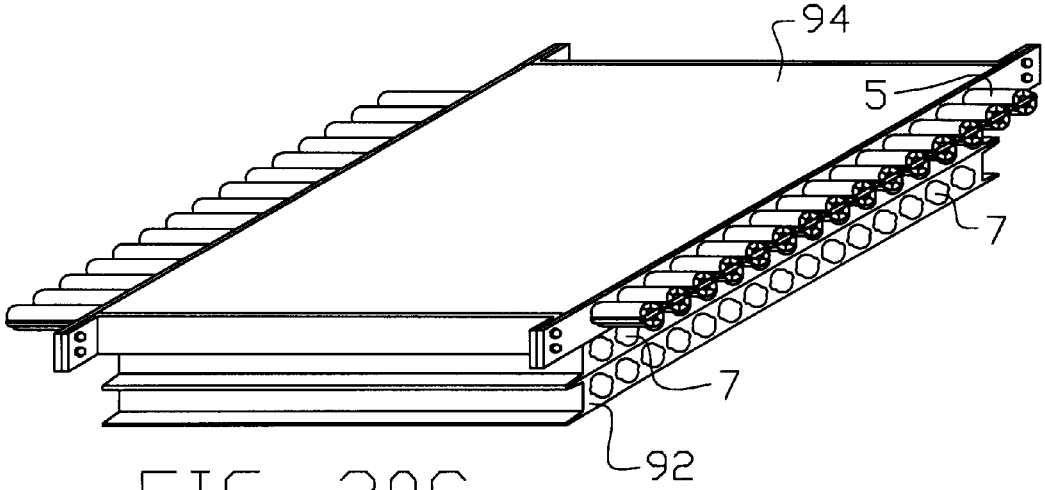
Figure 21:
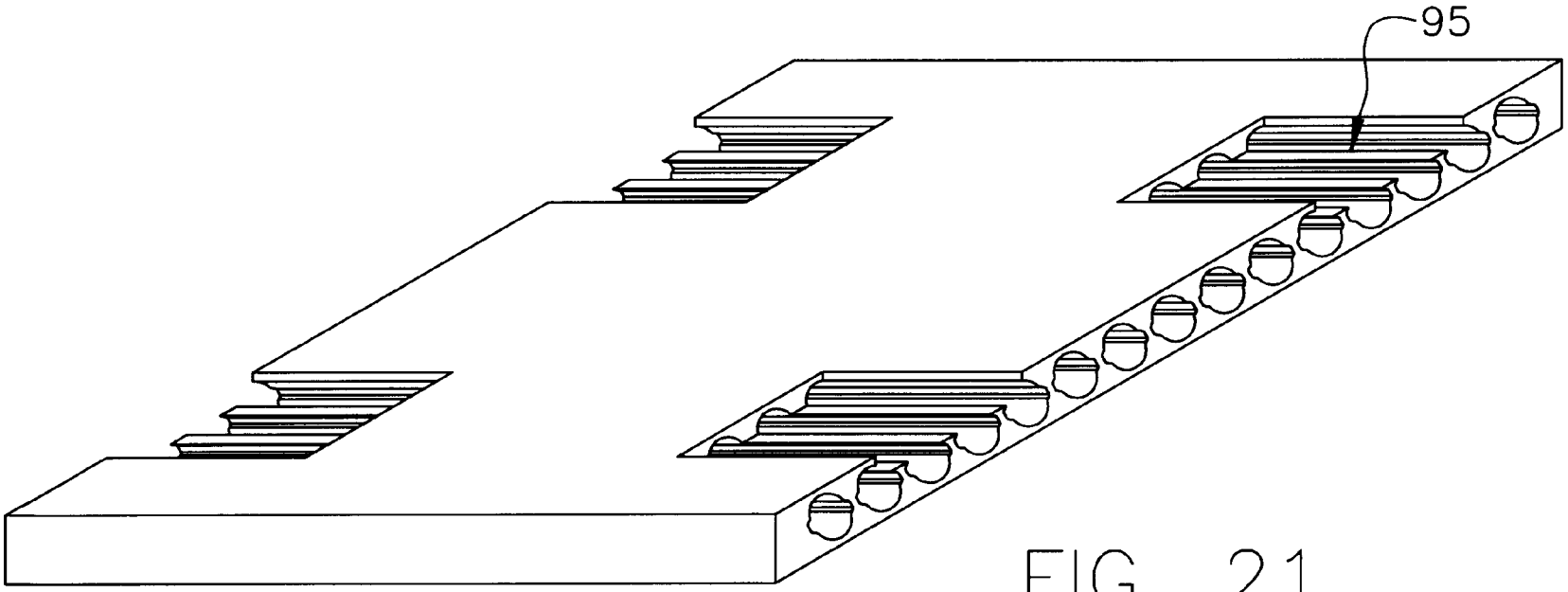
Figure 22:
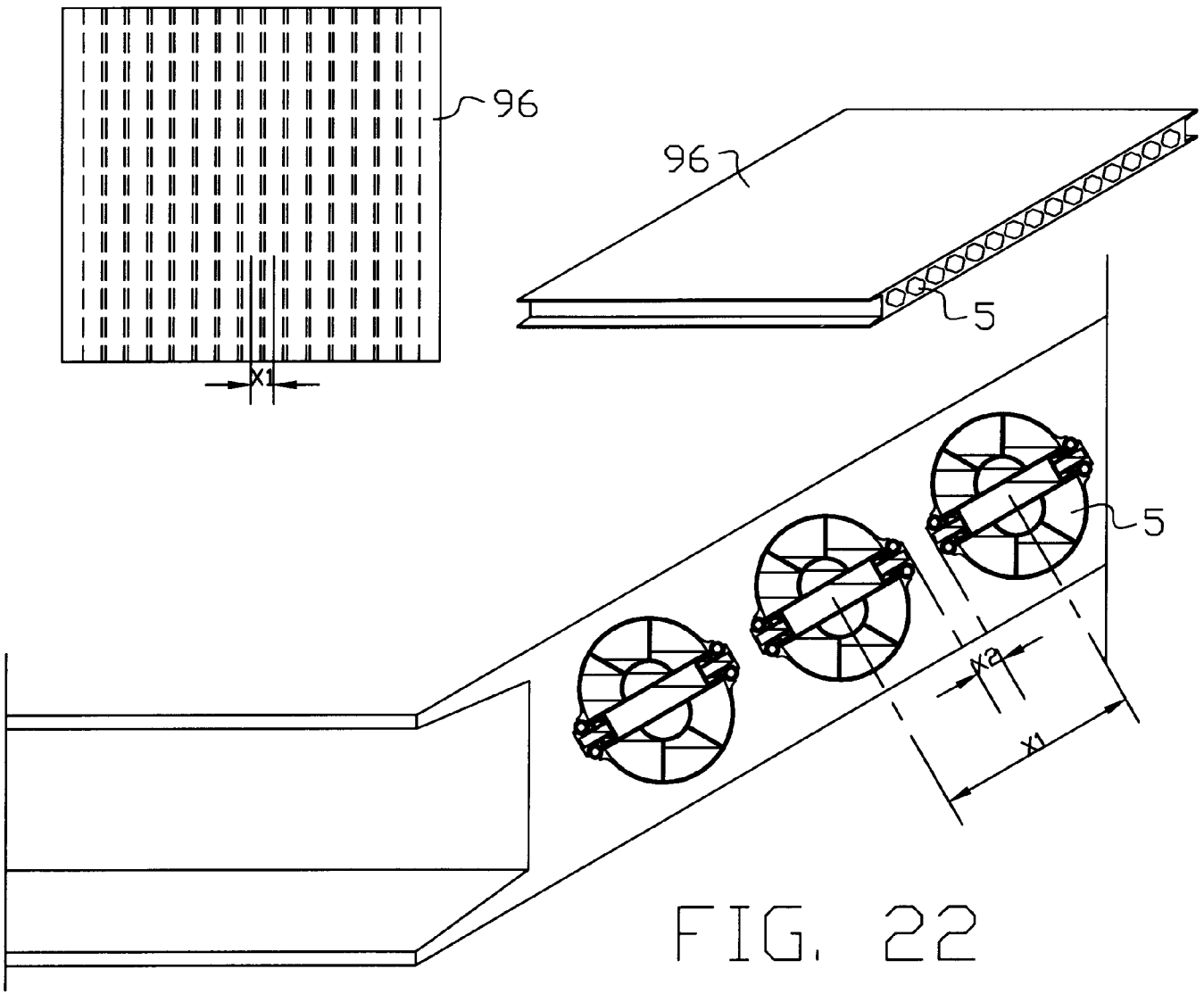
Figure 23:
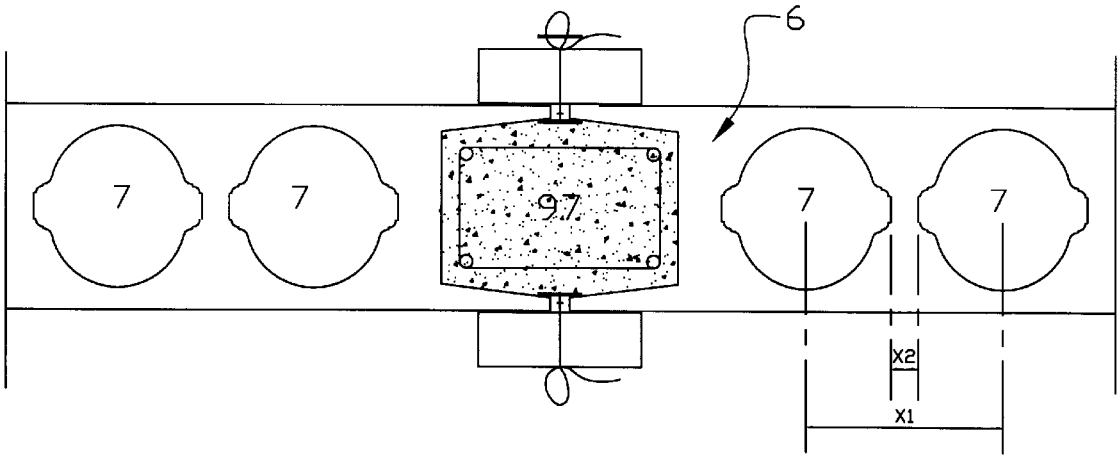
Figure 24:
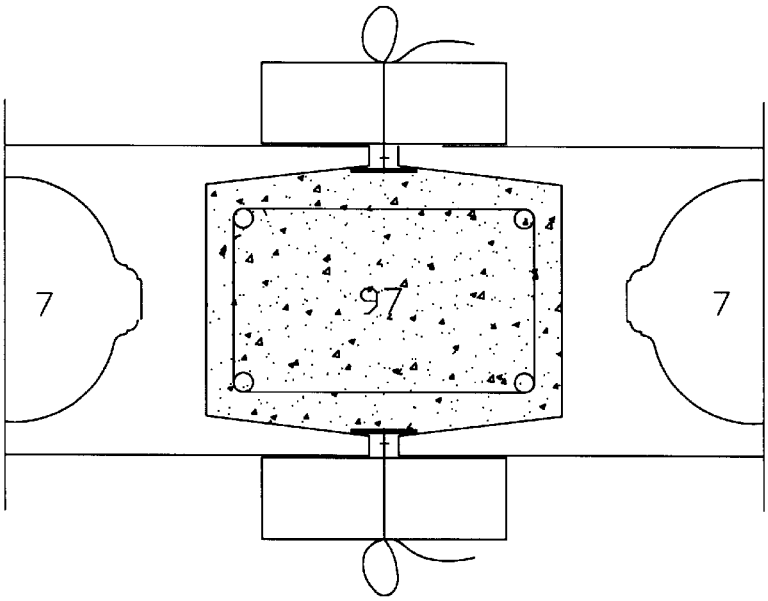
Figure 25:
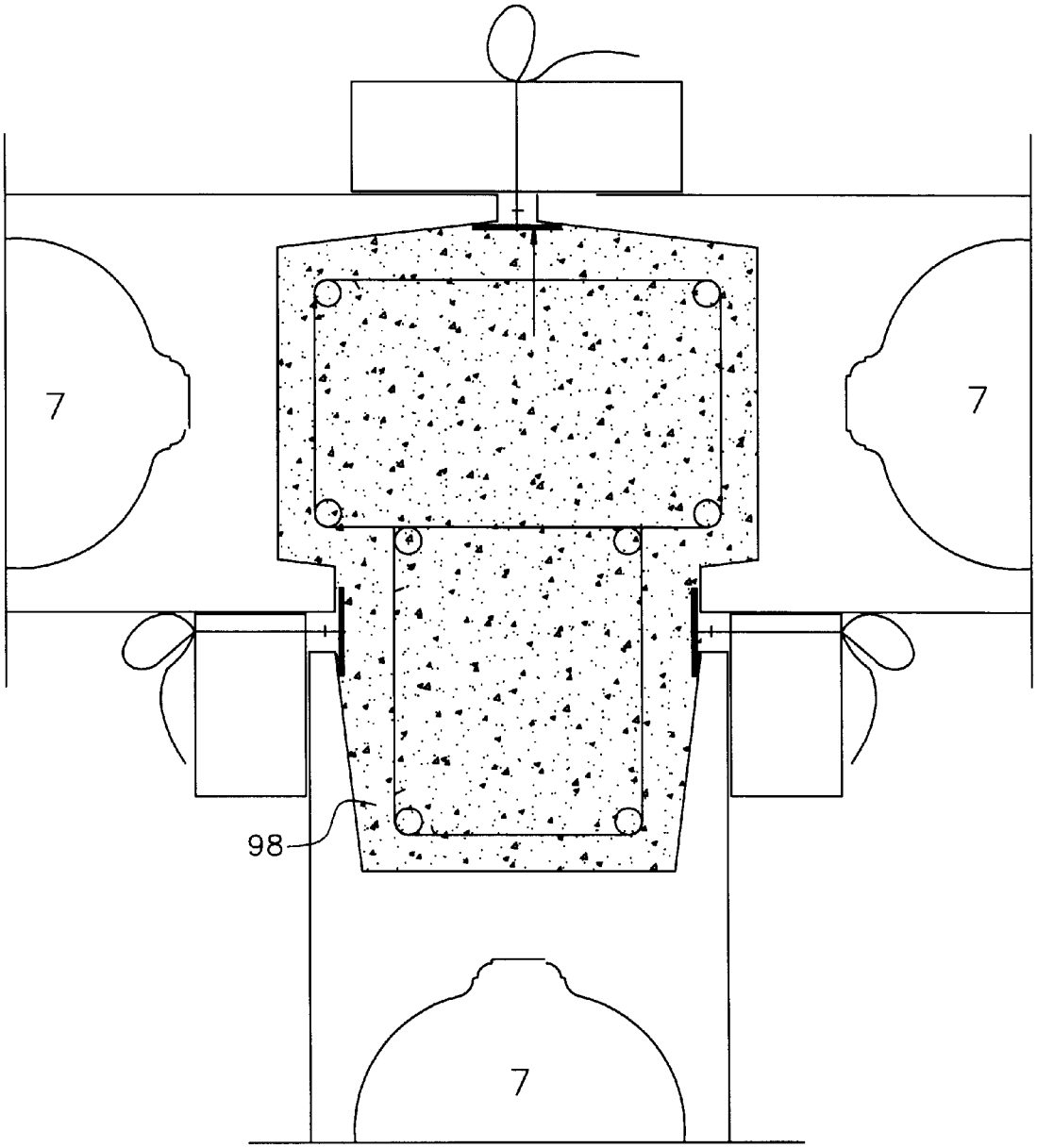
Figure 30:
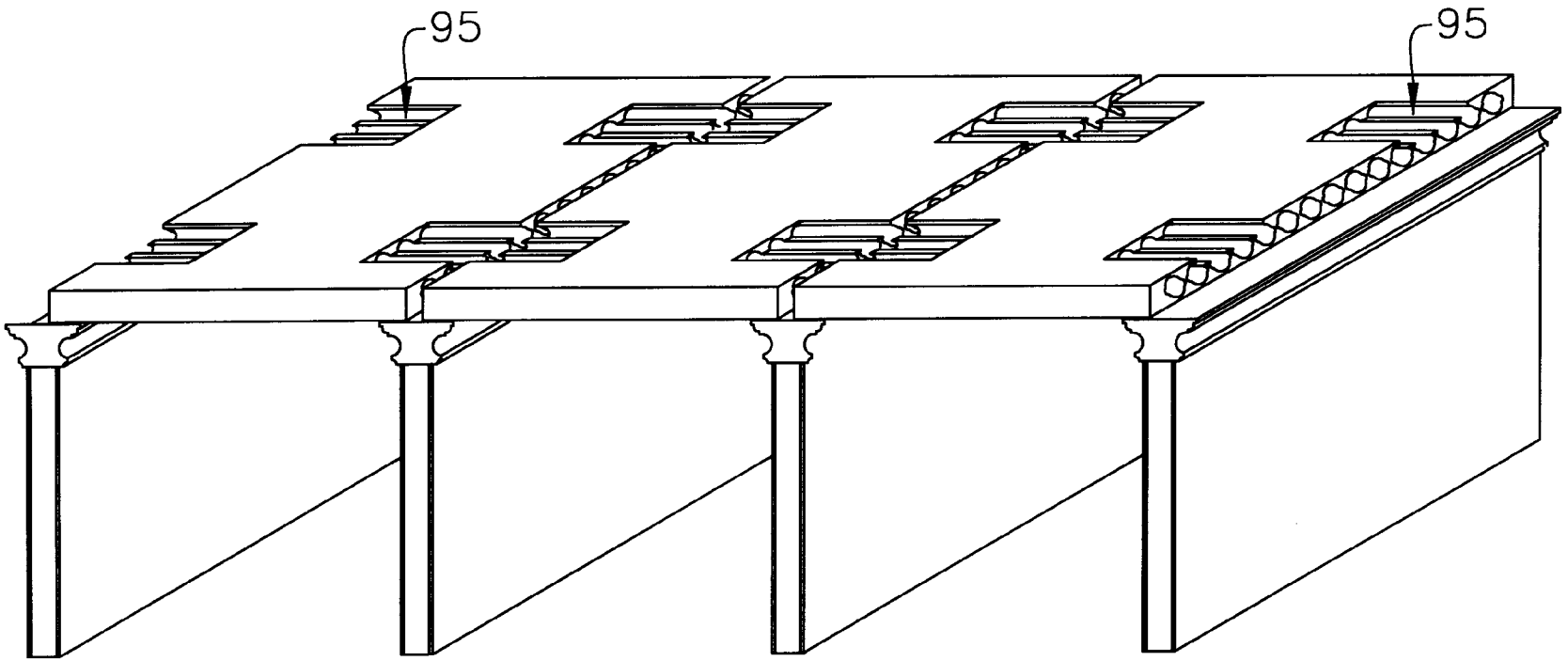

FIGS. 15 A–K shows a sequence of use of the set of FIGS. 14 and 14A in forming a core in that material;

FIG. 16 shows a fifth embodiment of a set of parts assembled to provide a former for forming a hexagonal core in concrete;

FIG. 17 shows a sixth embodiment of a set of parts assembled to provide a former for forming an octagonal core in concrete;

FIGS. 18 and 18A show use of a device for forming an opening in a core formed using a set of parts according to the invention;

FIGS. 19, 19A and 19B show metal caps for forming openings in precast walls or floor slabs formed using a set of parts according to the invention;

FIG. 20 illustrates schematically a sequence of casting operations using sets of parts according to the invention;

FIG. 21 shows a perspective view of a precast floor panel with an integrally formed opening for a construction joint;

FIG. 22 shows isometric views of a precast wall;

FIGS. 23 to 29 show various joints between walls and/or floor panels for use in a building construction method using sets of parts embodying the invention;

FIG. 30 shows a precast floor panel laid in position during building.

Figure 31:
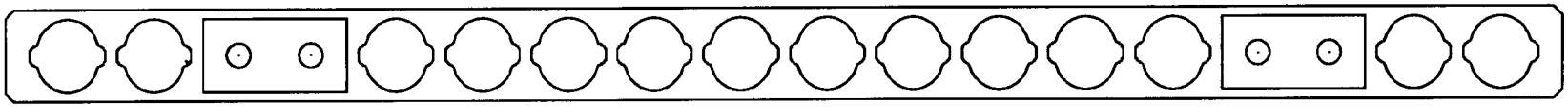
Figure 31A:
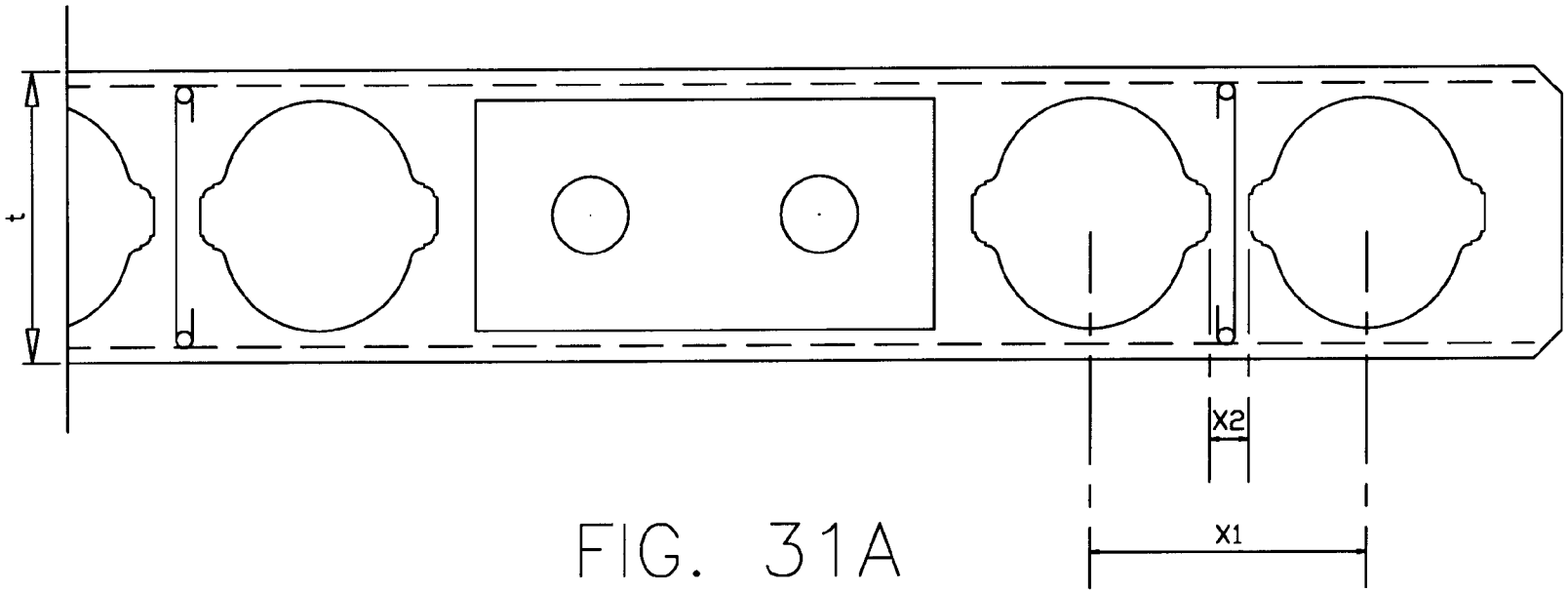

FIGS. 31 and 31A show a precast floor slab, made using a set of parts according to the invention, and incorporating a prestressing cable, FIG. 31A being an enlargement of part of FIG. 31.

Figure 1:
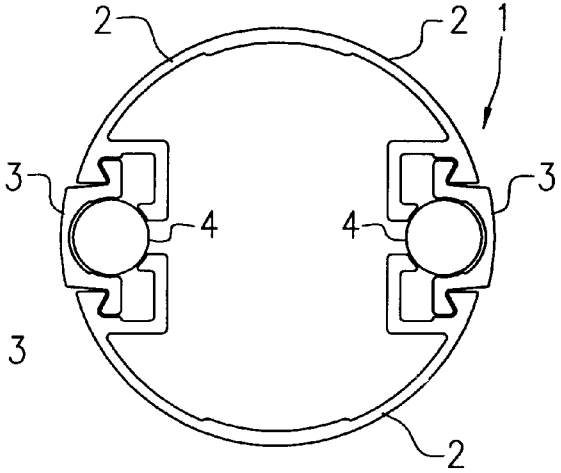
FIG. 1 shows a first embodiment of a set of parts according to the invention for use in building in an assembled condition.
Figure 2:
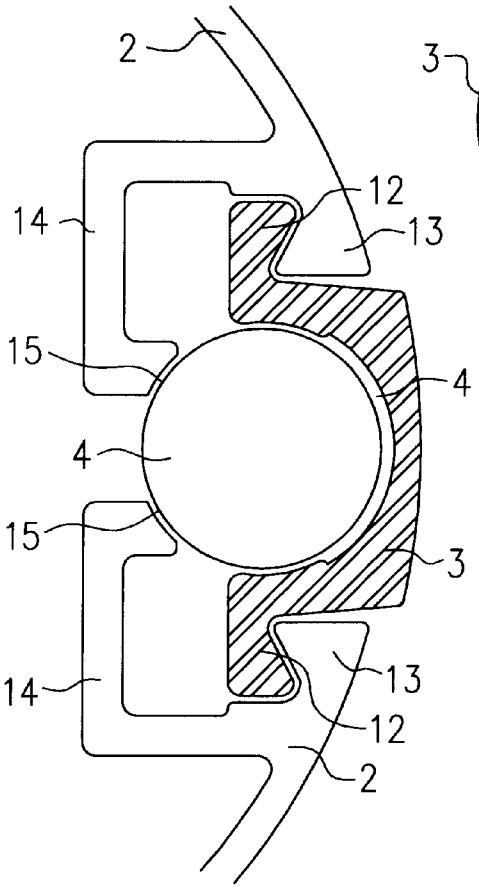
FIG. 2 shows an arrowed part 'A' of FIG. 1 to an enlarged scale.
Figure 32:
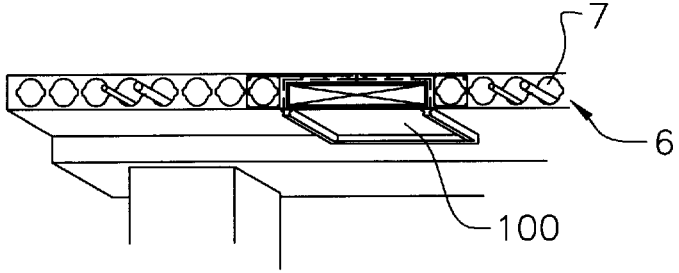
Figure 32A:
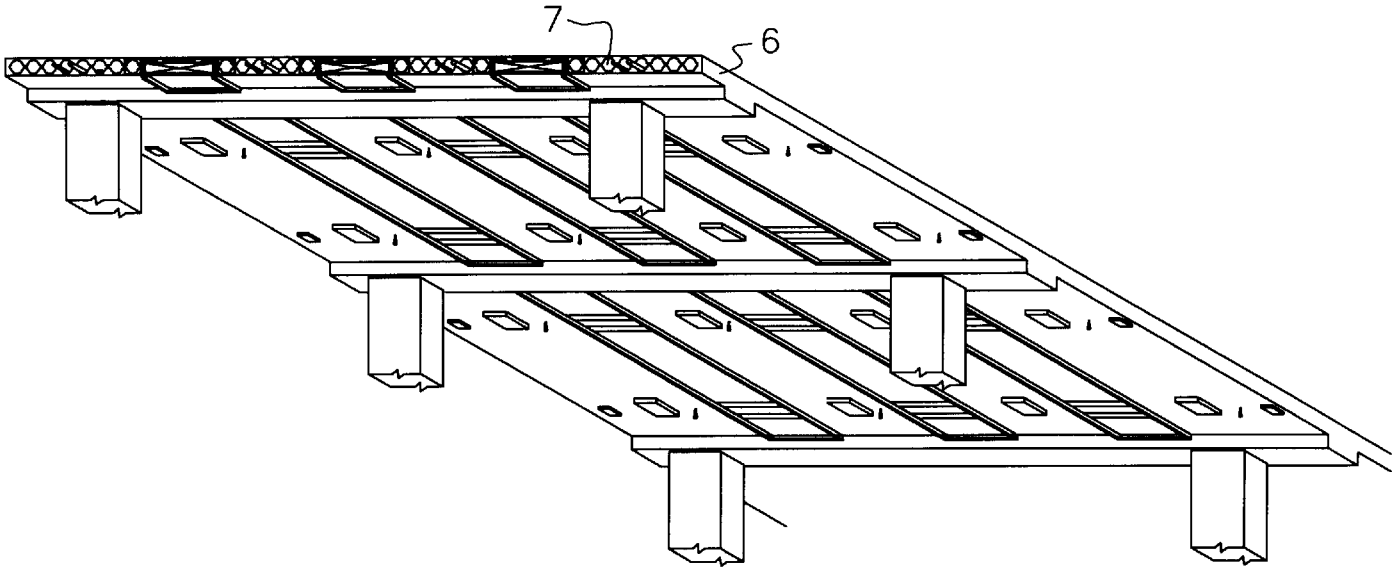
Figures 33, 33A:
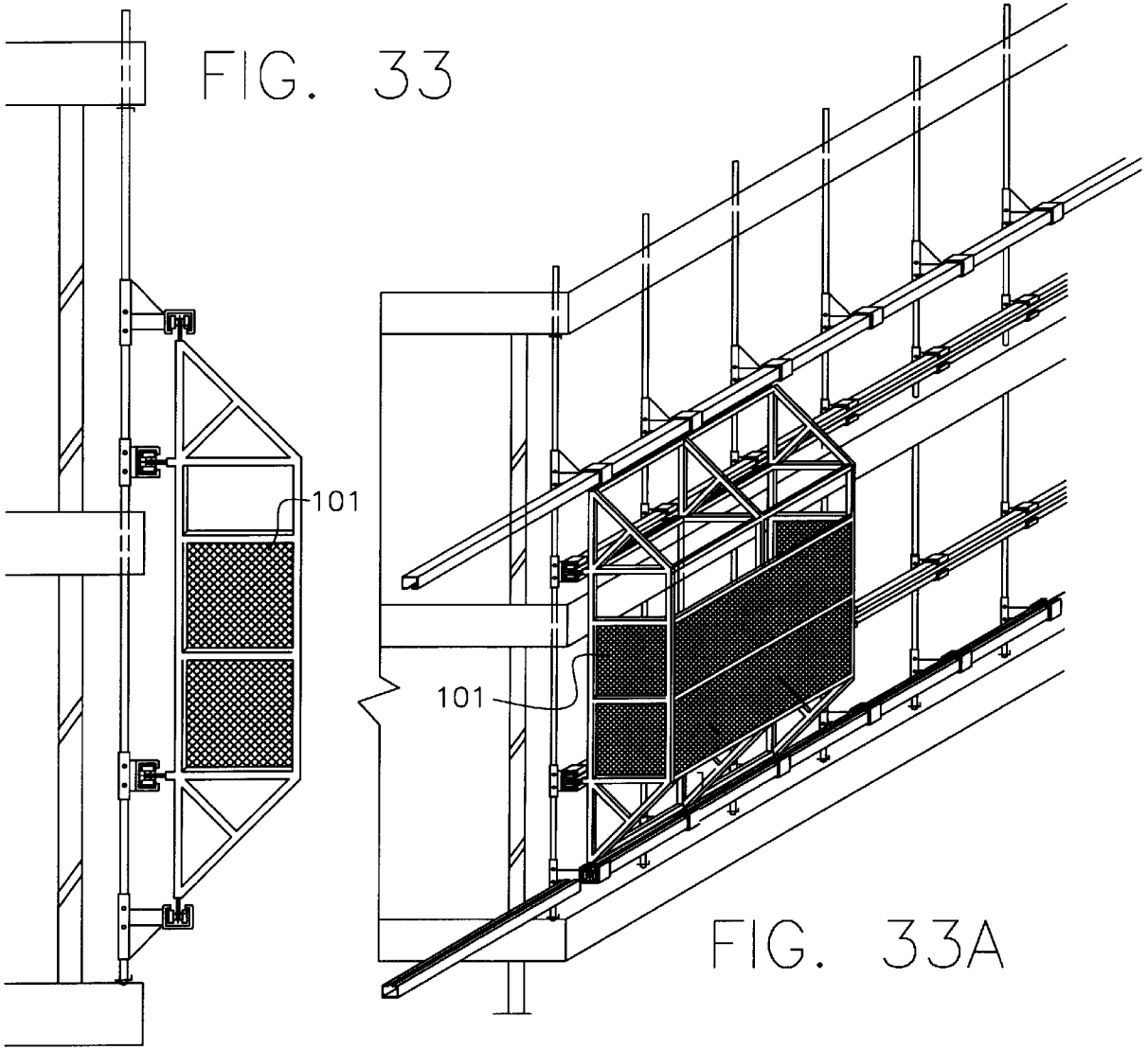
Figure 34A:
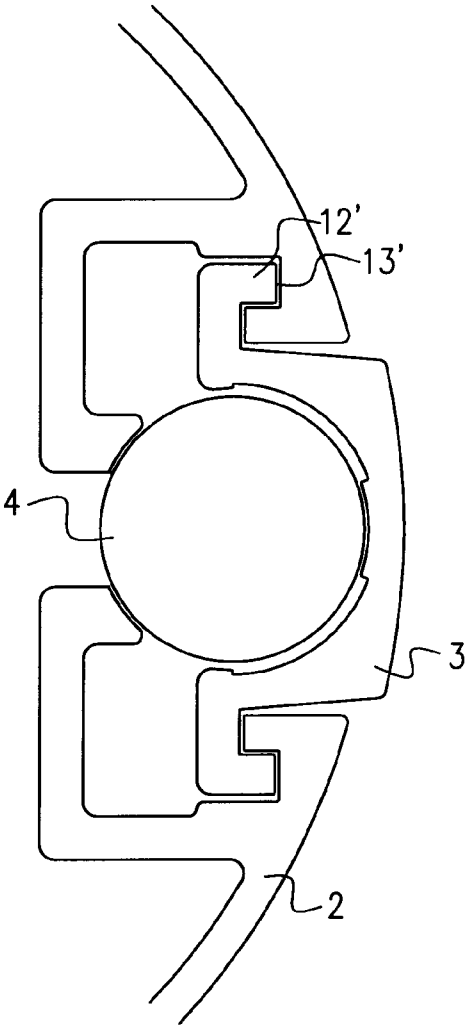
Figure 34:
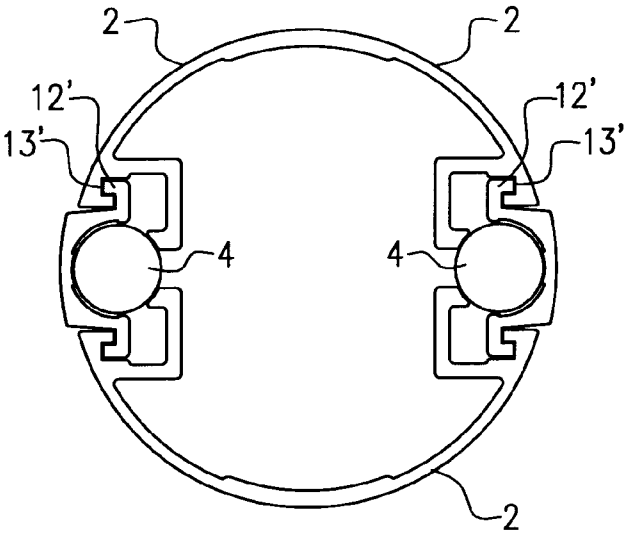
Figure 35A:
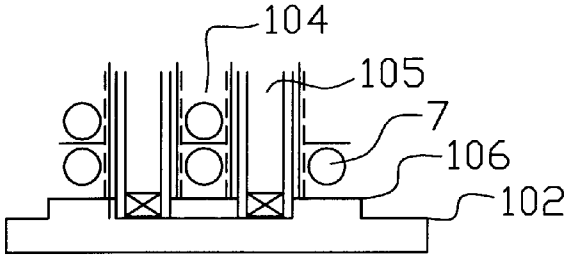
Figure 35:
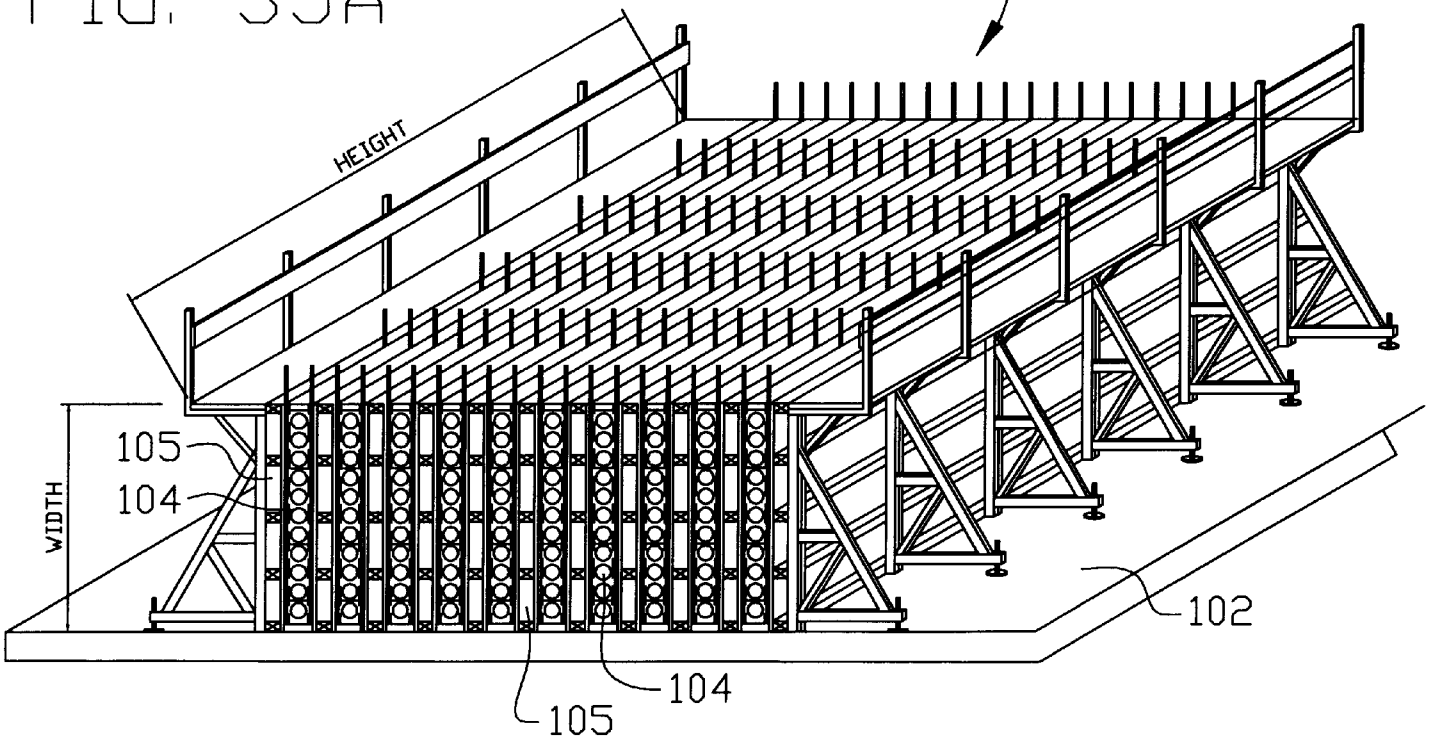
Figure 36A:
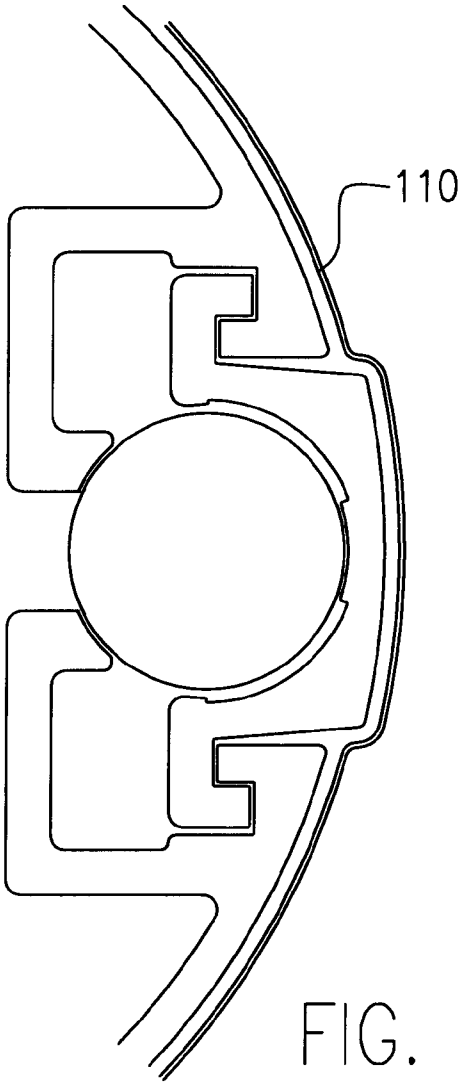
Figure 36:
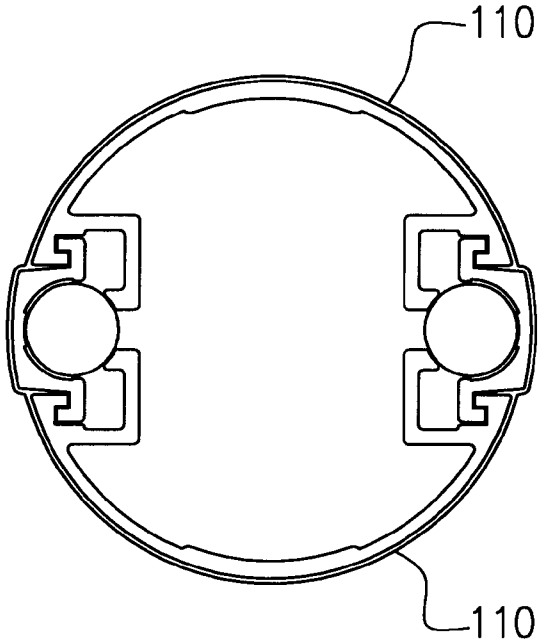
Figure 37A:
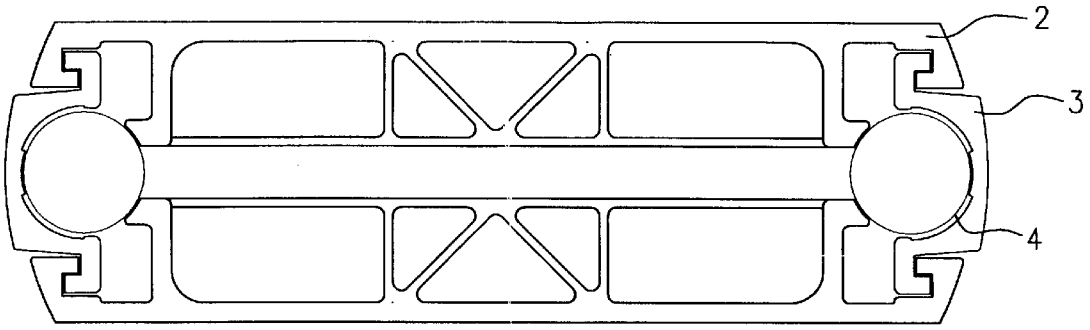
Figure 37:
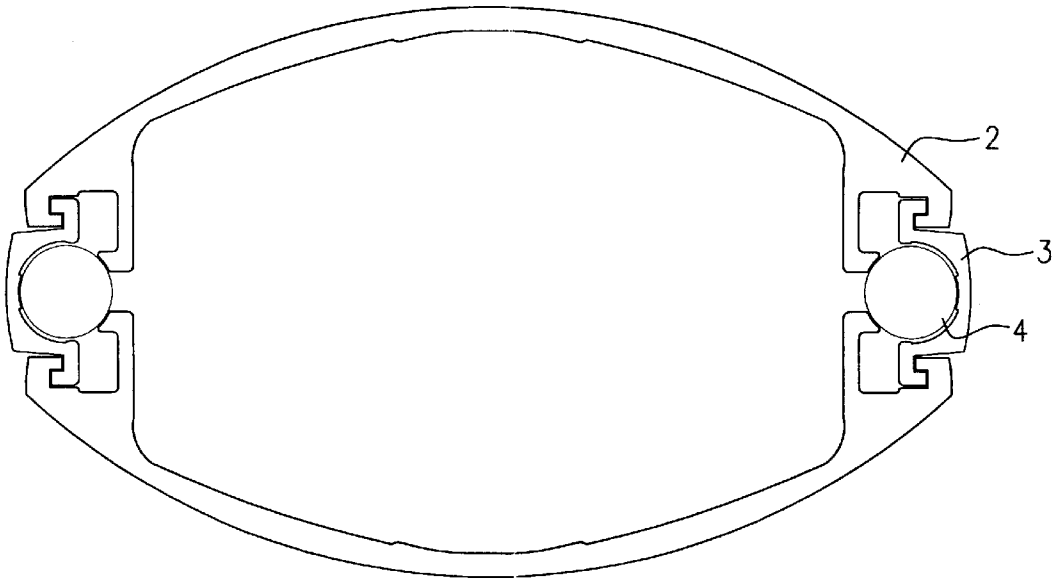
Figure 38:
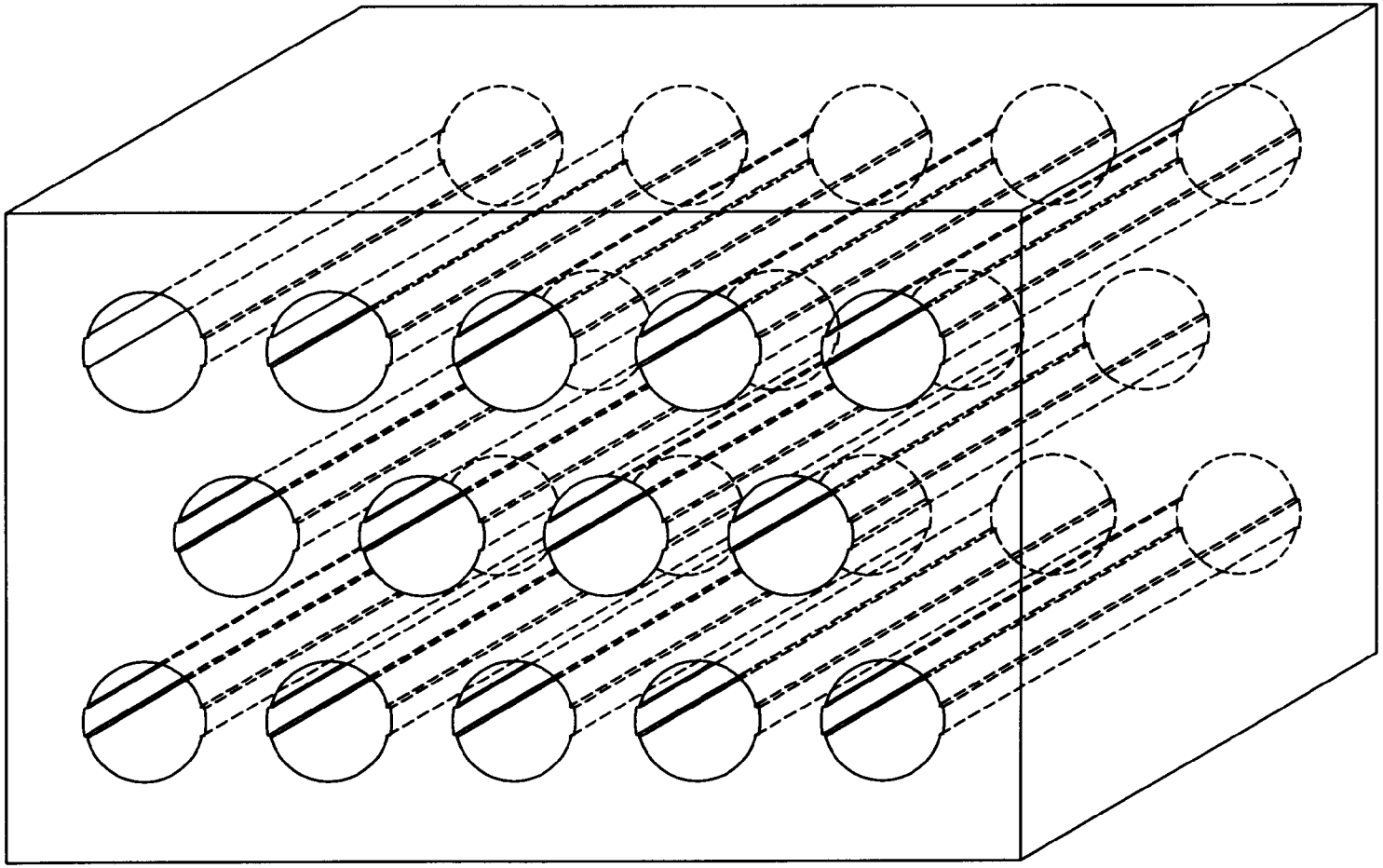
Figure 39:
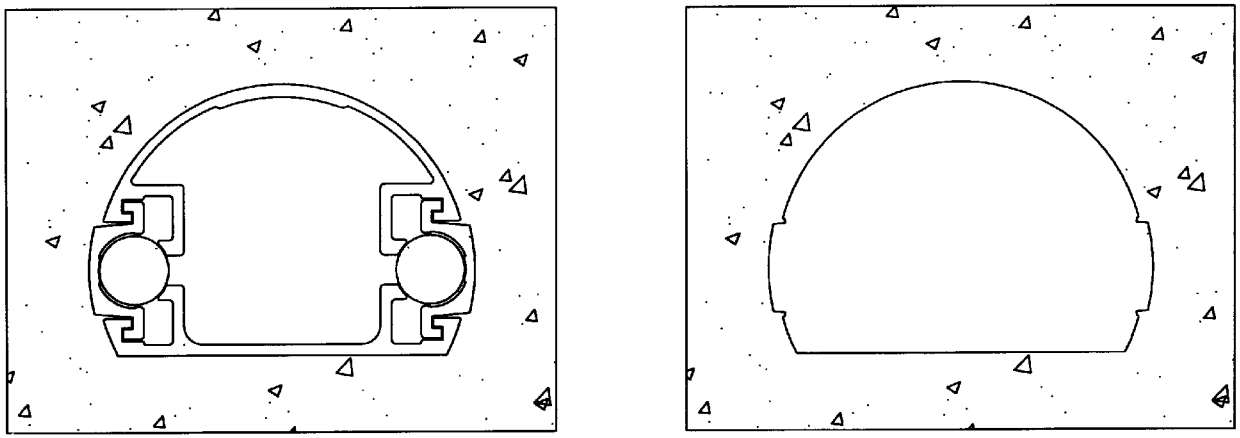
Figure 40:
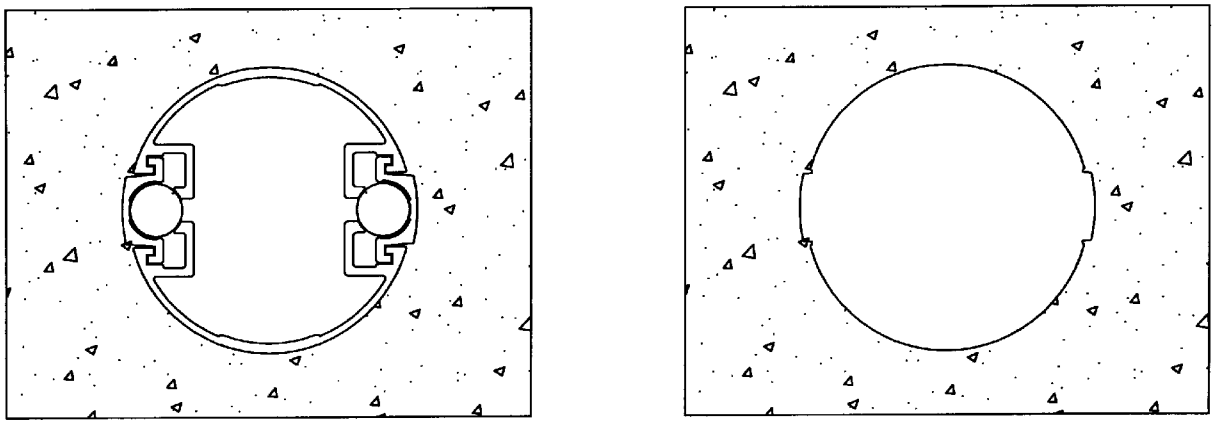

FIGS. 32 and 32A show a precast floor slab with various services included, the floor slab being made using sets of parts according to the invention, FIG. 32A being an enlargement of part of FIG. 32;

FIGS. 33 and 33A respectively show a side elevational view and a perspective view of a horizontally slidable scaffolding suspended from floor slabs made using sets of parts according to the invention;

FIGS. 34 and 34A show respectively a further embodiment, similar to FIGS. 1 and 2, of a set of parts according to the invention;

FIGS. 35 and 35A show respectively another constructional system and an enlarged part thereof, according to the invention;

FIGS. 36 and 37 show further embodiments of a set of parts according to the invention;

FIG. 38 shows a precast concrete block, made using sets of parts according to the invention; and FIGS. 39 and 40 show examples of the use of sets of parts according to the invention for the formation of culverts.

Referring to the drawings, there is shown a set of parts 1 for use in building, comprising a plurality of separate parts 2, 3, 4 which are assemblable to provide a former 5 for defining a desired configuration in a set settable material such as poured concrete 6, there being at least two interengageable surface forming parts 2, 3 and a thrust part 4 which maintains the parts 2, 3 in an assembled position, the thrust part 4 being removable to allow the surface forming parts 2, 3 to be removed from the set settable material 6 whereby to leave a desired configuration 7 in that material.

Referring now to FIGS. 1 to 9A, there is shown a first set of parts, comprising two generally arcuate surface forming parts 2, 3, forming a major part of the surface configuration desired 7, and which when assembled are spaced apart at free edges 8. The spaces between the parts are filled by two other surface forming parts 3. The two other surface forming parts 3 are substantially of channel section, the web thereof 9 being curved on an outer, in use, surface 10 and having an inner, in use, curved surface 11, for receiving a complementary part of the outer surface of the thrust member 4 which is itself in the form of a cylindrical rod of metal, rubber or other suitable material such as a PVC pipe.

The webs 9 of the channels 3 each have interengaging means in the form of hook-like members 12, of half-dovetail configuration in the embodiment, for engaging with hook-like means 13 of the parts 2 (FIGS. 2, 3), which are also of half-dovetail configuration. Thus the parts 2, 3 are releasably engageable by the complementary interengageable means 12, 13.

Figure 3:
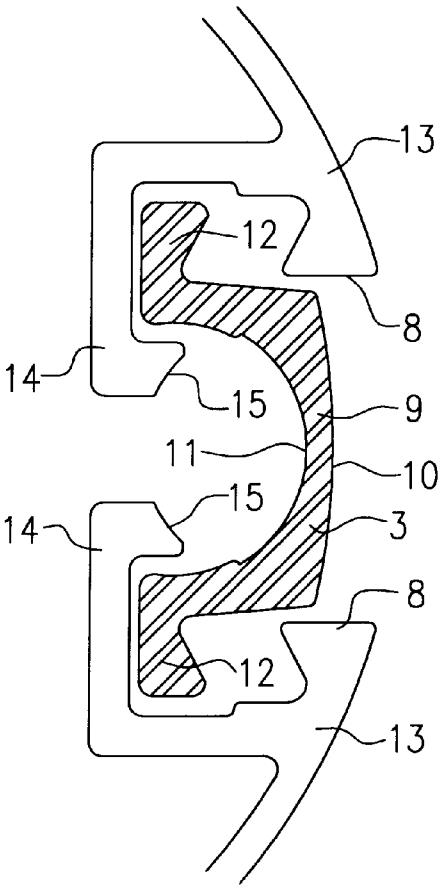
FIG. 3 shows steps in dismantling the set of parts of FIGS. 1 and 2 for removal from set settable material.

Referring now to FIGS. 34 and 34A, the set of parts shown therein is similar to that of FIGS. 1, 2 and 3 and is assembled and disassembled in an identical way. The difference is that in FIGS. 34 and 34A, the complementary interengageable means comprises a rectangular channel or socket 13' in which is received a spigot or projection 12'.

Each of the parts 2 has adjacent its free edge a hook-like member 14 which acts as a guide, and seating, for the thrust member 4, the guide 14 having a curved seat 15 complementary to the configuration of the outer surface of the thrust member 4.

In use, the set of parts 1 is assembled to provide a former 5 by offering up the parts 2 and 3 so that the interengaging means 12, 13 interengage, and the thrust member 4 is then inserted by sliding between the parts 2 and 3 and curved surface 11 and the guide means 15 so that it maintains the former 5 in an assembled position. (It will be understood that there are two such thrust members 4 in this embodiment, but only the assembly (and disassembly) of one is described as the operation is identical for both).

Figure 4:
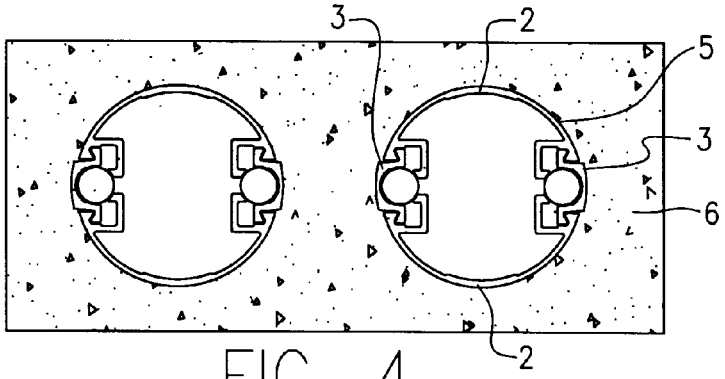
FIGS. 4 to 9A show steps of the dismantling of the assembled set of parts of FIGS. 1 and 2 to leave cylinders in the set settable material, FIG. 6A corresponding to FIG. 3.

To use the former 5 in building to form for example a cylindrical hollow core 7 in poured concrete 6, the former 5 is placed in a desired position, there being reinforcement such as steel rods also placed in position prior to pouring as desired. The concrete 6 is then poured, in the embodiment to surround the former 5, which it will be understood is in the assembled position of cylindrical configuration. The poured concrete 6 sets round the former 5, or formers 5, there being as many formers 5 as hollow cores 7 required (two are shown in the embodiment). (FIG. 4).

Figure 5:
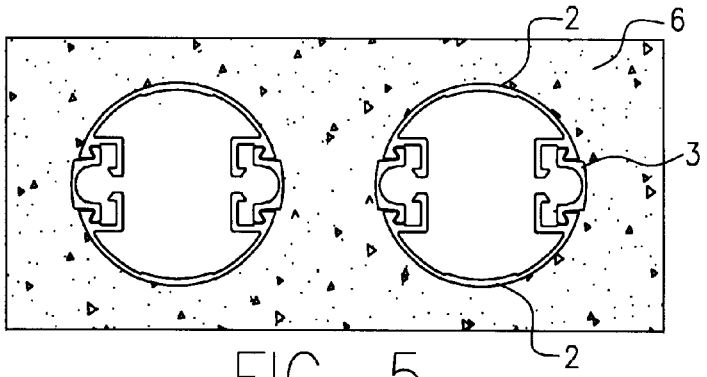
Figure 5A:
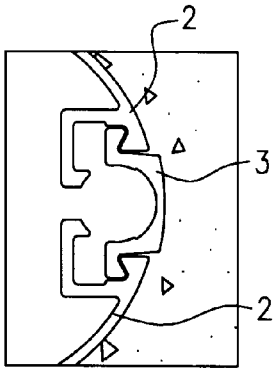
Figure 6:
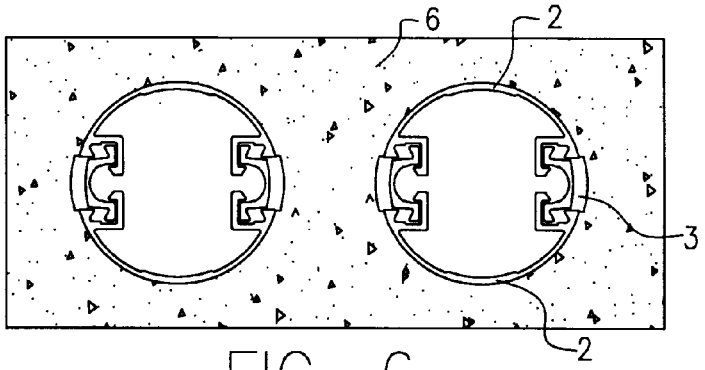
Figure 6A:
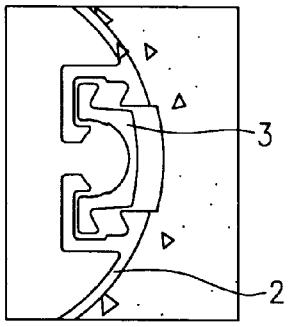

Once set, the thrust member 4 is removed by sliding it out longitudinally so that it is free of the parts 2 and 3 (FIGS. 5, 5A). The channels 3 are then moved transversely inwardlv (as viewed), away from the concrete. (FIG. 6, 6A).

Figure 7:
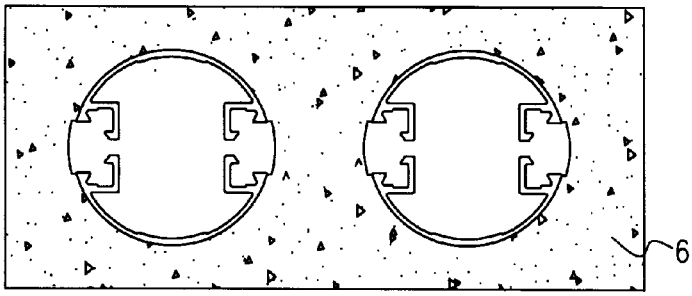
Figure 7A:
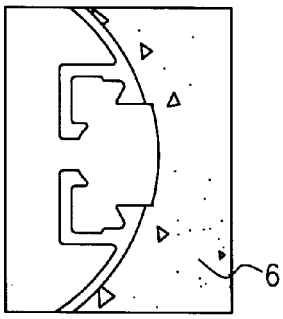

The channels 3 are then removed longitudinally by sliding out (FIGS. 7, 7A).

Figure 8:
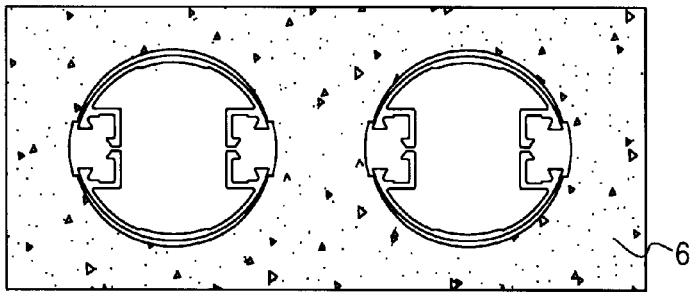
Figure 8A:
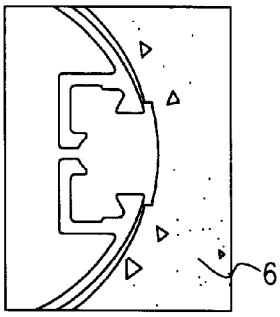

The parts 2 are then pulled inwardly, transversely away from the concrete 6, so that their respective hook-means 14 are almost touching. (FIGS. 8, 8A).

Figure 9:
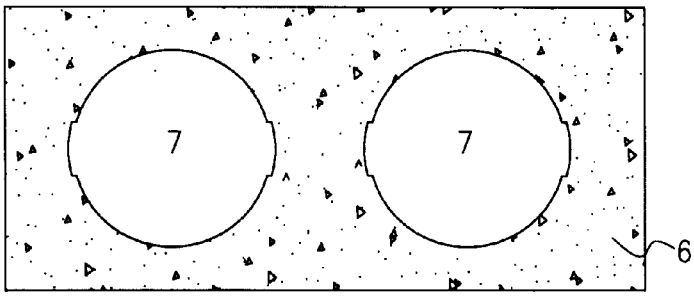
Figure 9A:
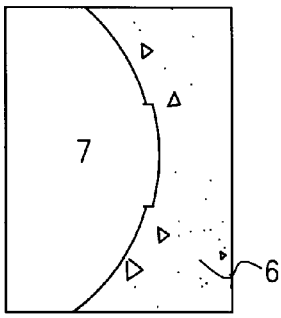

The parts 2, now released from the concrete 6, are now pulled out of the concrete, leaving a desired cylindrical hollow core 7 formed in the concrete. (FIGS. 9, 9A). Thus a panel can be formed, with through holes or cores 7 which can be used for insulation or heating or cooling.

Figure 10:
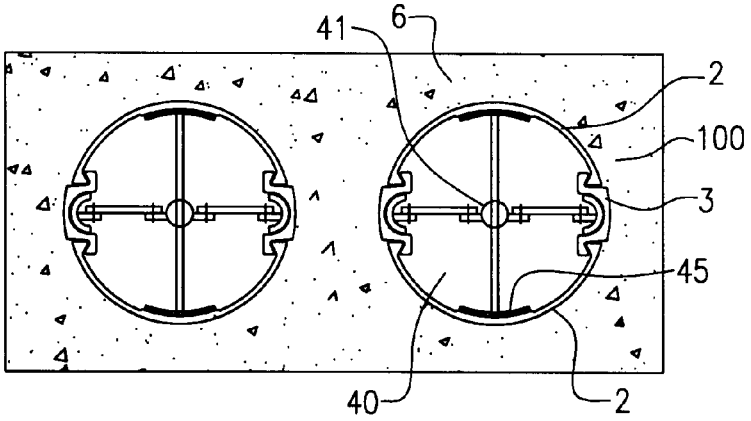
FIGS. 10 to 10J show steps, similar to FIGS. 4 to 9A in use of another embodiment of a set of parts according to the invention.
Figures 11, 12:
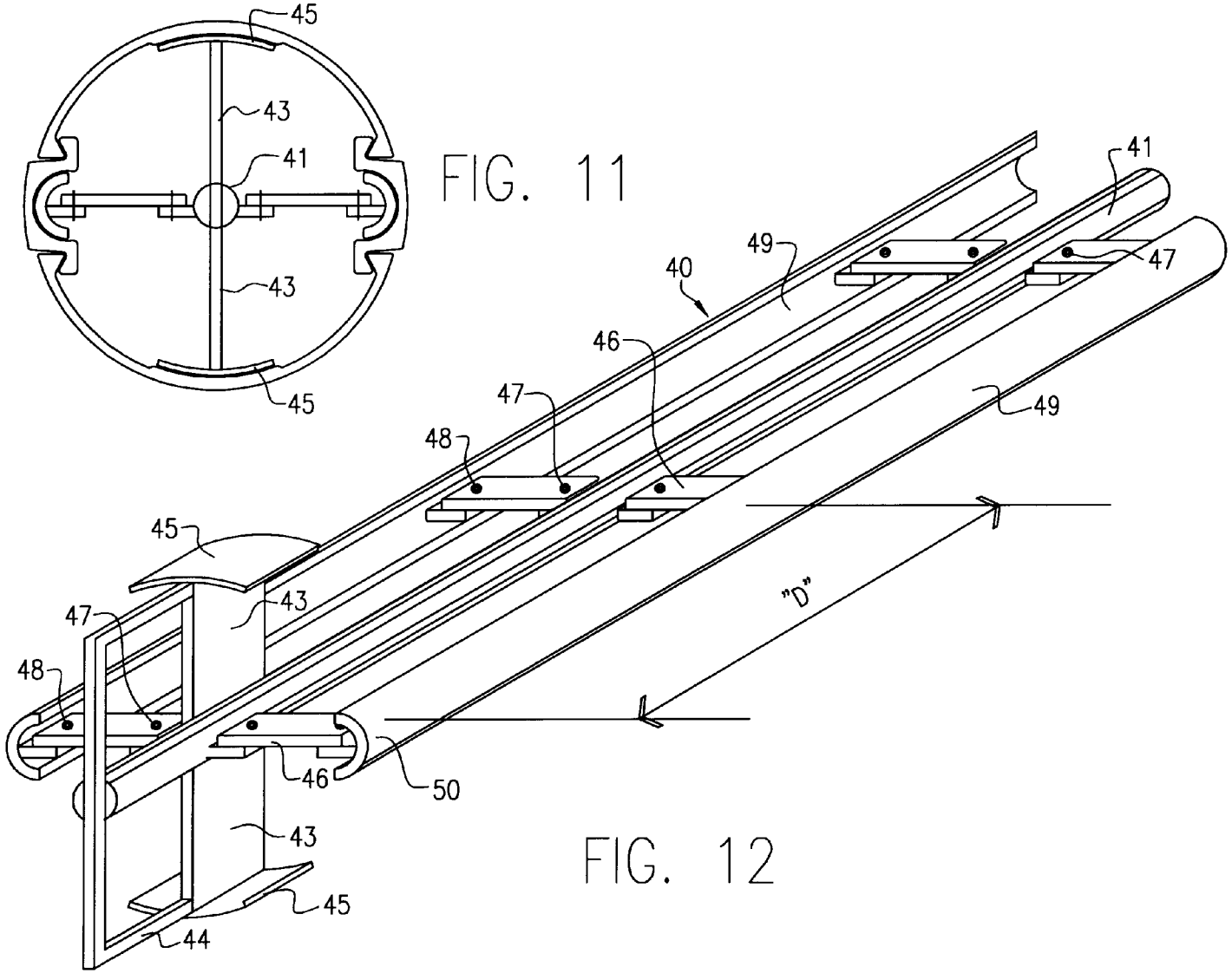
FIG. 11 shows an enlarged assembled set of parts according to FIG. 10.
FIG. 12 shows the assembled set of parts of FIG. 11 in perspective.

The second embodiment 100 shown in FIGS. 10 to 12, is similar to the first embodiment; the same reference numbers are used for similar features.

In this second embodiment the parts 2 forming the major surface of the desired formed configuration do not have the additional guide and seating means 14. They are unnecessary as the thrust member 40 (FIG. 12) is in the second embodiment, a substantially centrally located member having an elongate central body 41 supporting a plurality in this case four, of arms 42 arranged symmetrically around the member 41. Two of the arms 42 lie substantially in the same plane and are located adjacent one end of the member 4' and support a handle 44.

Each arm 42 has a curved thrust part 45 for engagement with a complementary curved inner surface of the parts 2. The other two arms comprise spaced apart arm parts 46 which are pivotably connected to the member 41 by hinges or pivots 47 at one end and which support at the other, again by hinges or pivots 48, an elongate nose member 49 which has a curved outer, in use, surface 50 for complementary engagement with the inner (in use) curved surface of the channels 3.

The arms 42 are connected with a mechanism such as a slidable rod (not shown) set in the member and which is itself connected with the arm parts 46.

In use, on pushing the handle 44, the arm parts 46 are pivoted and thrust outwardly to the position shown (FIG. 12) so that the nose members 49 engage the channels 3 and therefore maintain the parts 2 and 3 interengaged by their interengaging means 12, 13, the parts 2 being supported by the curved thrust parts 45.

Figure 10A:
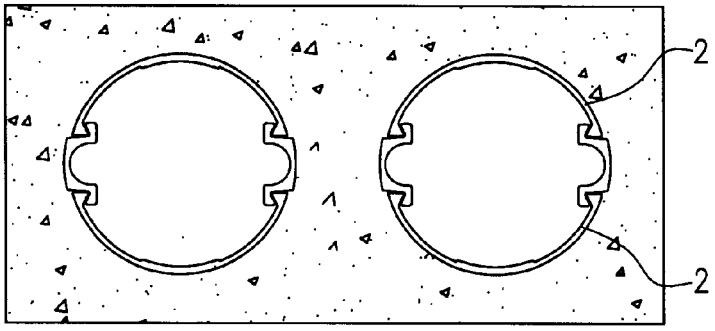
Figure 10B:
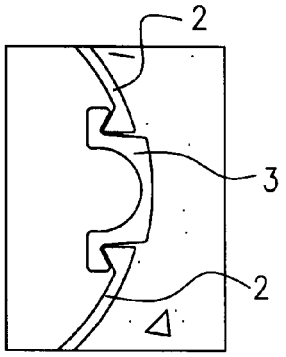
Figure 10C:
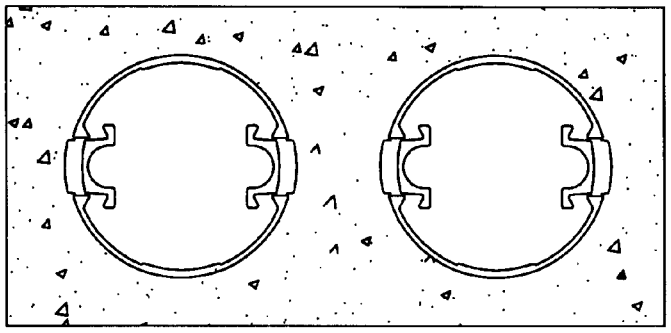
Figure 10D:
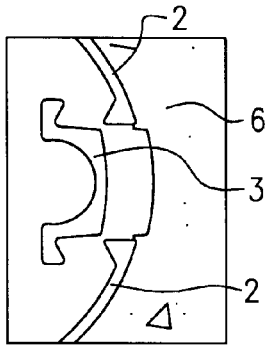
Figure 10E:
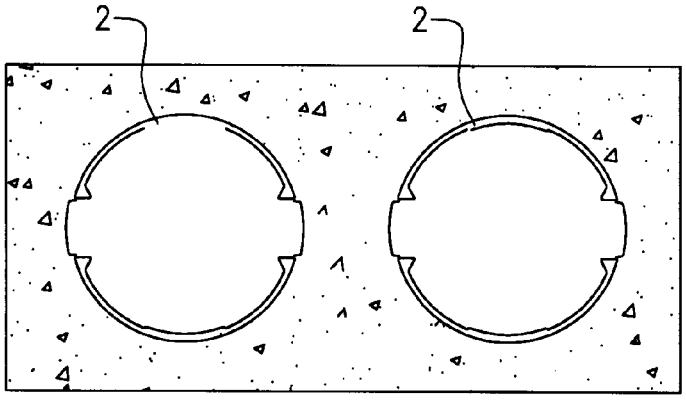
Figure 10F:
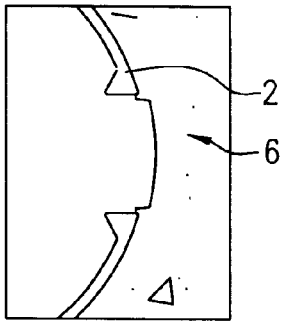
Figure 10G:
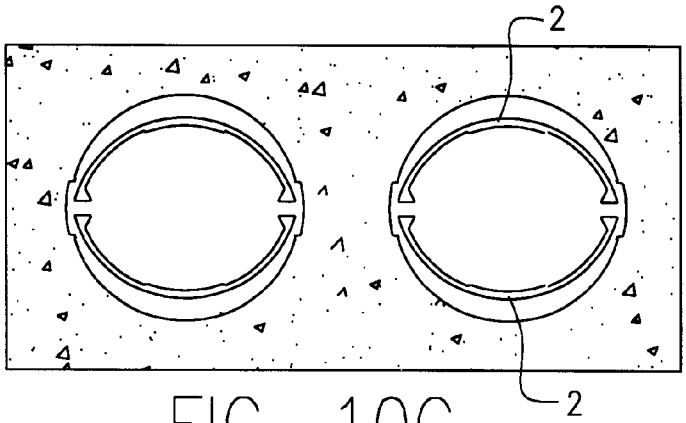
Figure 10H:
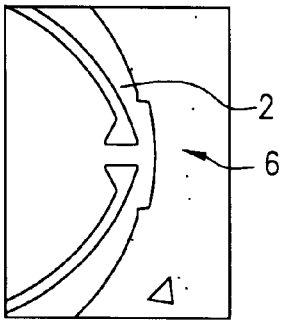
Figure 10I:
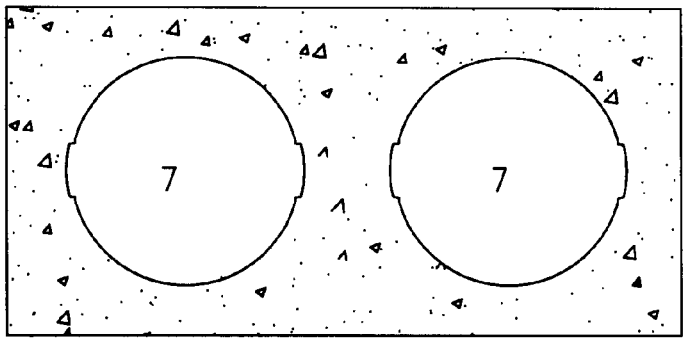
Figure 10J:
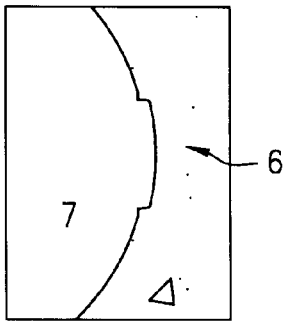

Concrete 6 is poured as before (FIG. 10), and when it is set, the handle 44 is pulled, to release the thrust parts 45 from the inner surface of the parts 2 and also to pivot the arm parts 46 so that the nose members 49 are pivoted out of engagement with the channels 3. The former 40 is removed, by sliding out of the cylinder, (FIGS. 10A, B), the channels 3 are then removed, (FIGS. 10, 10C) (as in the first embodiment), and then the parts 2 are also removed, as in the first embodiment, as shown in FIGS. 10E–10H, to leave the desired cylindrical hollow cores 7 in the concrete. (FIGS. 10I, 10J).

It will be understood that the parts 2, 3, 4, 40 and components thereof can be made of any suitable material and by any suitable method, such as by extrusion of metal.

It will also be understood that in use in building construction, accessories such as shuttering, metal caps and the like can be adjacent the former 1, 40 before pouring the concrete 6 to form openings for mechanical, plumbing and electrical services, and for joint construction as required.

It will also be understood that a set of parts embodying the invention provides for a flexible building method according to structural engineering requirements. Thus not only can cylinders 7 be formed in the concrete 6, but edge holes can also be formed in for example side form work.

Referring now to FIGS. 13 and 13A and 14 and 14A, there are shown respectively therein two additional embodiments 50, 51 similar to those already described, and in which in both cases there are two cylindrical thrust members 4 which are received by complementary surfaces 52 of the two parts 2 and 3.

Figure 13A:
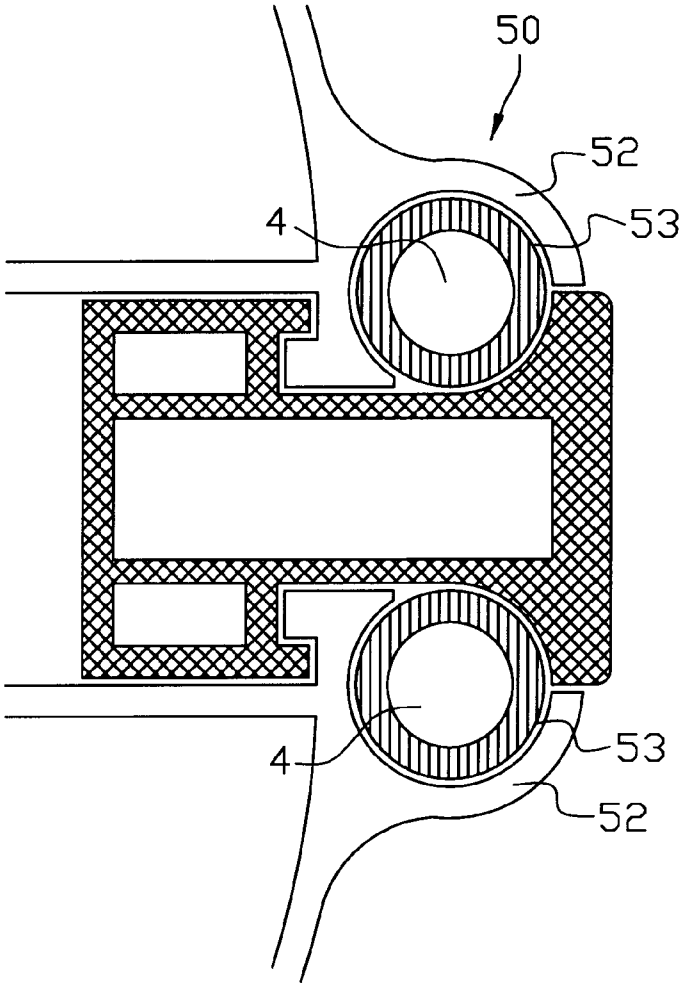
FIGS. 13 and 13A show a third embodiment of a set of parts according to the invention, FIG. 13A showing an enlarged part of FIG. 13.
Figure 13:
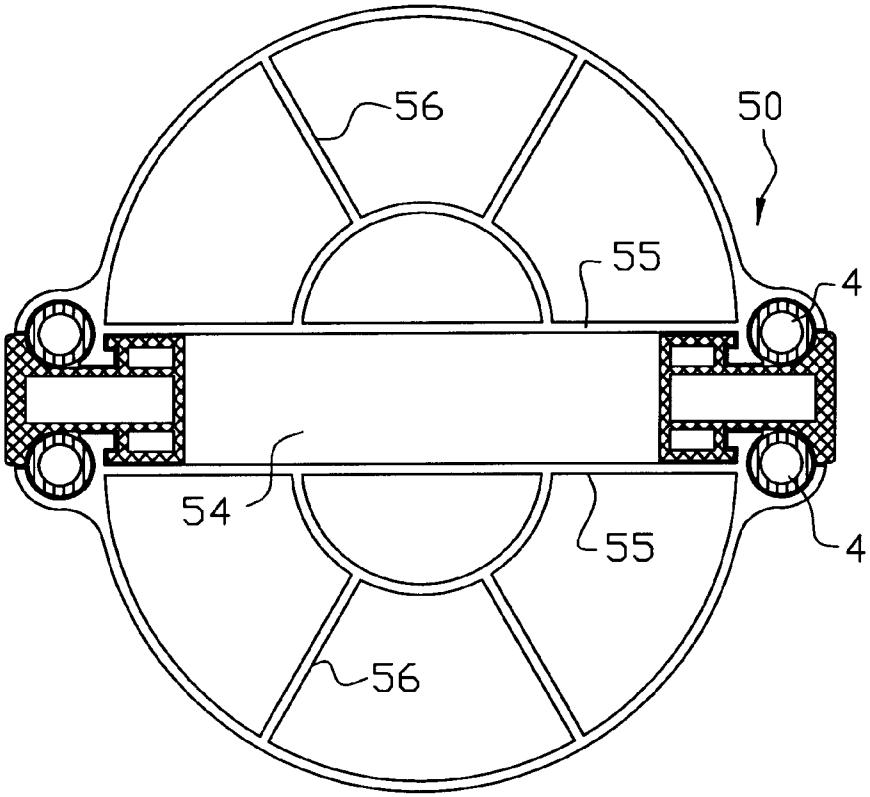

In FIGS. 13, 13A, the surface 52 virtually touches the part 3, while in FIGS. 14 and 14A the surface 2 terminates short thereof.

In both embodiments, the parts 2 define when assembled a tube 54, walls 55 supported by struts 56. The part 3 is a plug received in the tube 54 for sliding thereinto on disassembly from set poured concrete, as shown in FIGS. 15A–K.

FIGS. 16 and 17 show two more embodiments 60 and 70, respectively providing a hexagonal and octagonal bore in concrete 6, in other respects the operation being similar to that described with respect to FIGS. 15A–K.

FIGS. 18 and 18A show a stool or yoke 80 placable on the former 5 before pouring, at desired spacings to form an opening in the wall of a cylinder formed using a set of parts according to the invention.

Likewise, FIGS. 19–19B show how an opening is formed in a precast wall, using metal caps 90, 91 laid on a former made from a set of parts embodying the invention and used to create a bore 7 in a precast floor slab or precast wall.

In a building or construction method to form multi-layered pre-cast concrete panels 96, sizes of side-formwork can be adjusted in accordance with the structural engineering requirements. Holes opening along the side-formwork are cut in accordance with the shape of the former. A distance X1 and X2 centre to centre (FIG. 22) is adjusted to comply with structural engineering requirements.

In FIGS. 35 and 35A there is shown further building construction using a set of parts embodying the invention, in which there is a concrete screed, float or floor 102 which supports a structure 103 comprising alternate panels 104, formed of concrete in the embodiment shown, and formwork 105 in the form of glass fibre panels. The concrete panels 104 each have superposed bores 7 of the desired configuration (cylindrical in the embodiment shown) providing lightness yet with strength. The concrete screed has a floor kicker 106.

Day 1—Once the side-formwork has been fixed and the steel reinforcement and cylinder have been placed into the positions, the concrete will then be poured into the side-formwork.

Day 2—Remove the formers 5, as hereinbefore described. The sideformwork is now removed and placed above the concrete panel cast the day before and the former will be inserted into the holes and the concrete can be poured thereinto.

Day 3—Repeat the same cycle.

An advantage of the multi-layered casting of pre-cast concrete panels is that it is easy to handle and there is no requirement for heavy plant and machinery. It saves space as it is multi-layered. Furthermore there is no requirement for skilled workers as the cycle is standardised, and repeatable.

Figure 26:
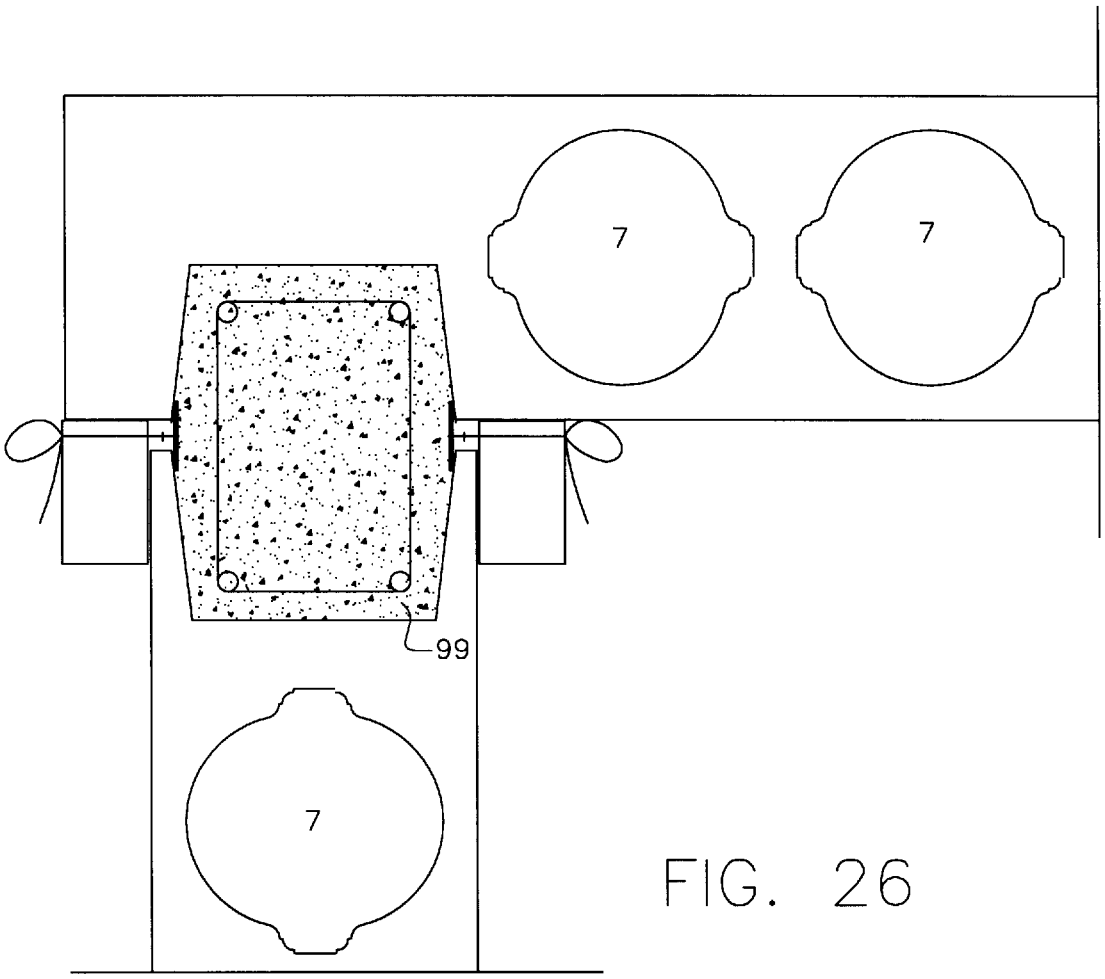
Figure 27:
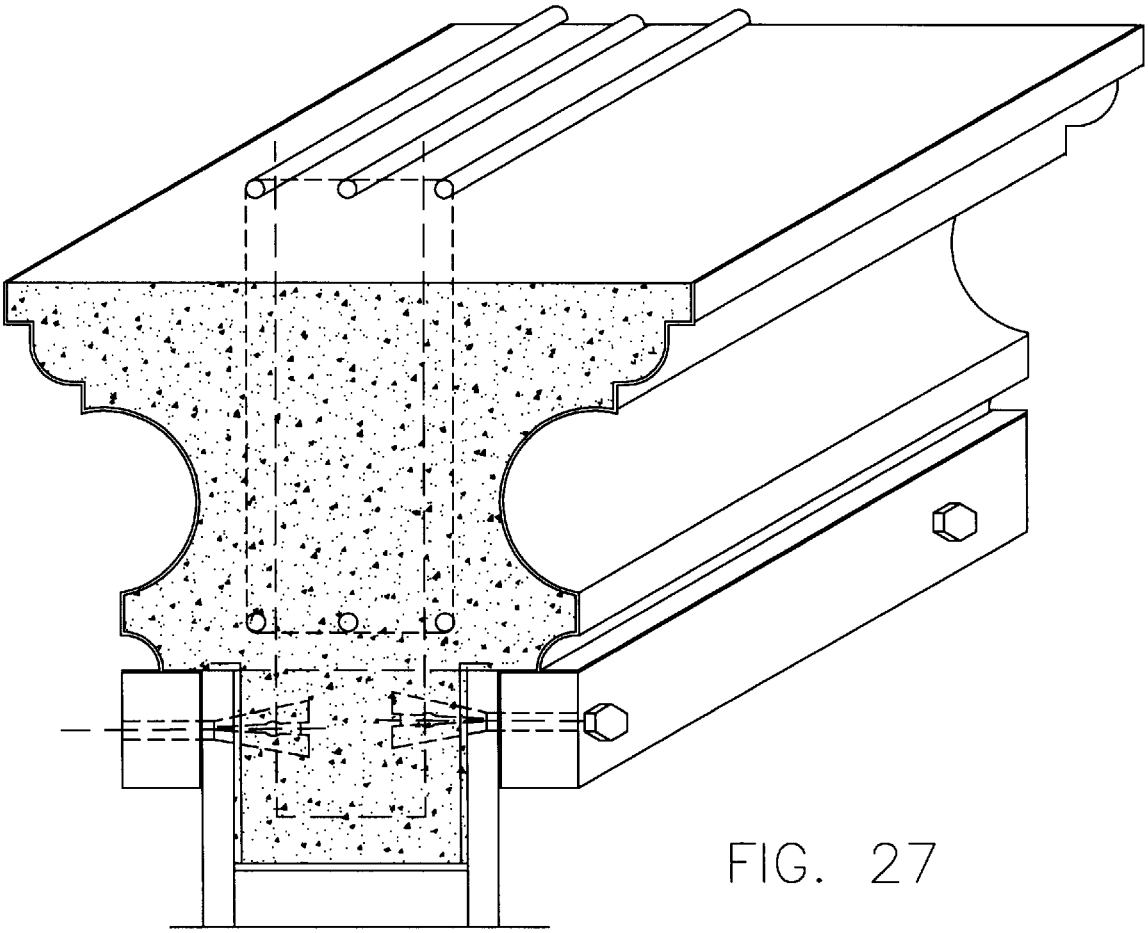
Figure 28:
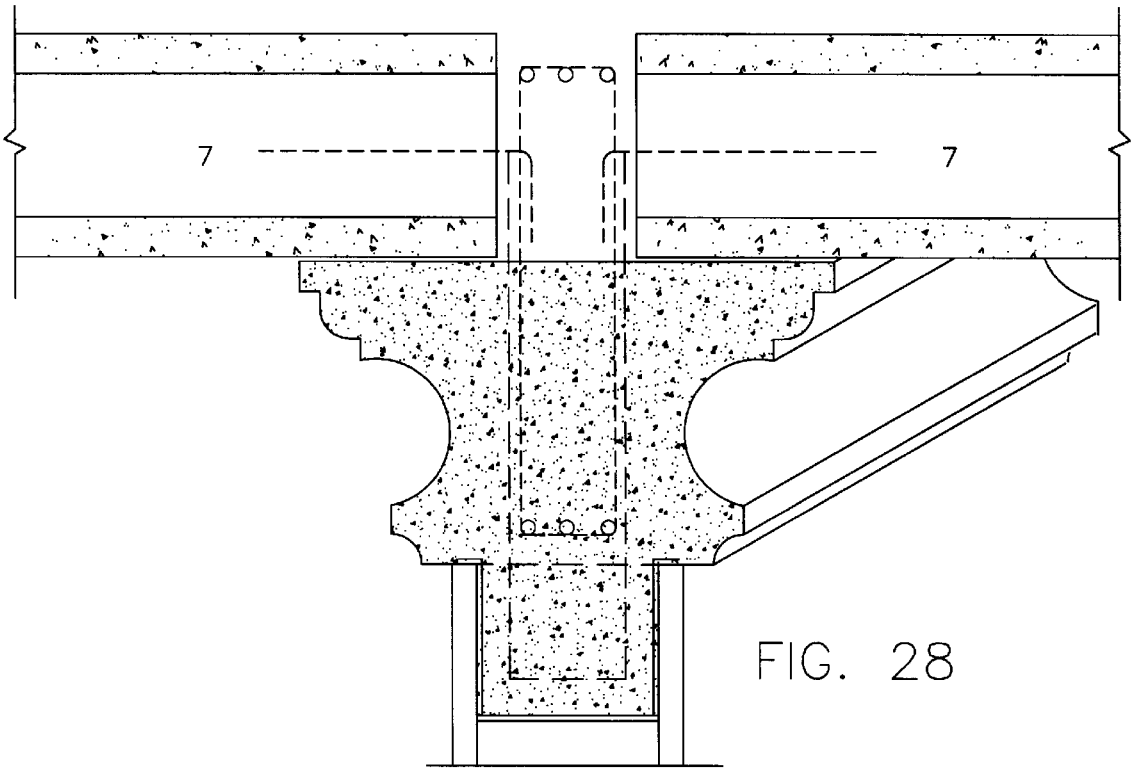
Figure 29:
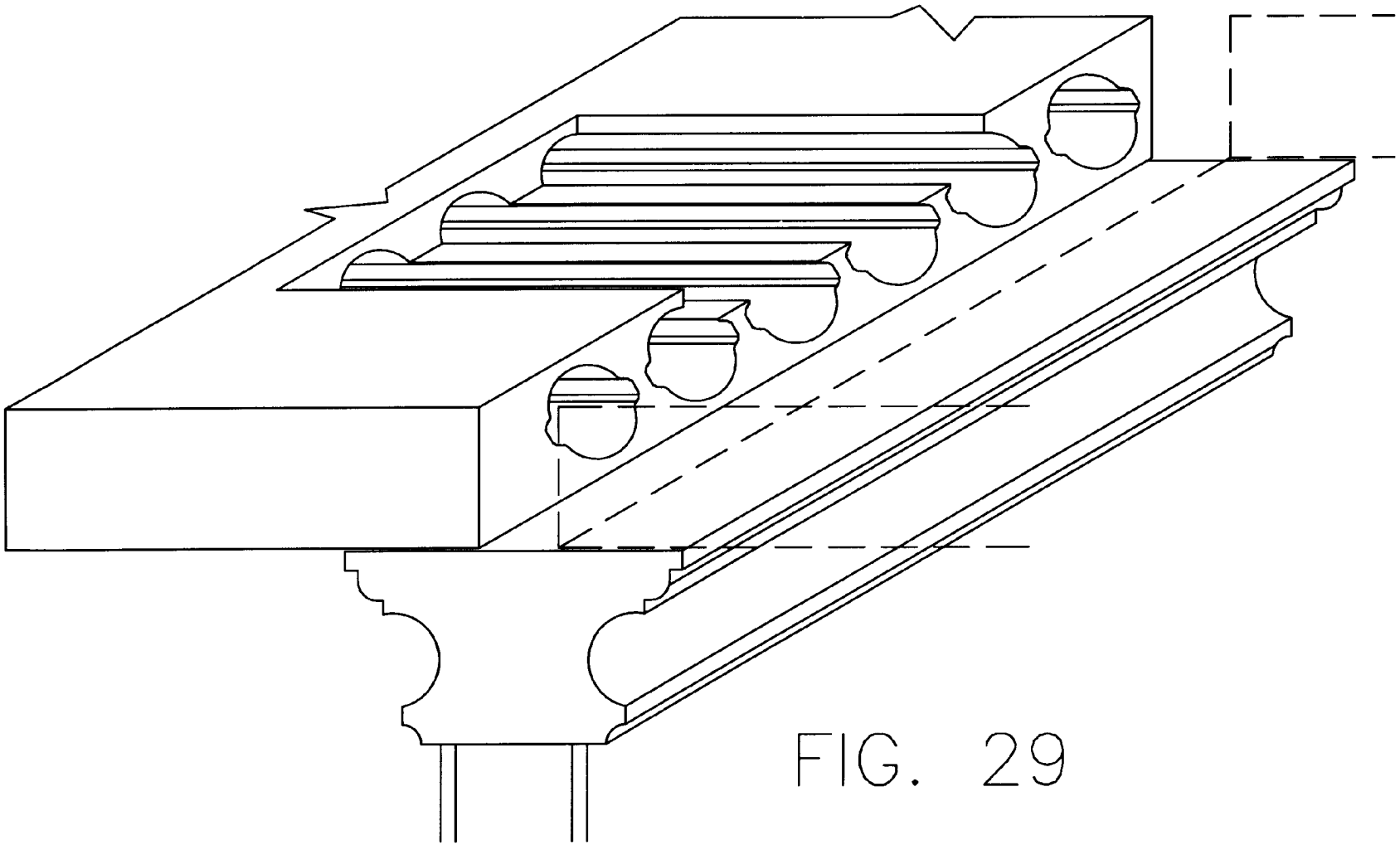

Walls can be jointed by using a straight joint 97, (FIGS. 23, 24), T joint and cross join 98, (FIG. 25), and L joint 99 (FIG. 26). If necessary an additional column can be added by using the cylindrical cores 7 in a cast wall panel and fitting in an additional steel reinforcement and concrete. The gap or space allowance for the lift in formwork is a special design for the adjustment of alignment.

Once the wall panels have been erected, the necessary adjustment for the floor and slab level may be carried out (FIG. 27) as follows:

1. Setting out the floor slab level.
2. Temporary hard wood timber packing to control the floor level and support the floor beam formwork.
3. Insert the glass fibre, galvanized iron or p.v.c. shoe to the hollow core cylinder to support the in-fill concrete.
4. Ready made aluminum mold or metal mold formwork to the side of the beam of which will rest on the timber packing.
5. Steel reinforcement to the beam will be added if necessary.
6. Pour the concrete and level it.
7. Remove the floor beam side-formwork (FIG. 28).
8. Place the pre-cast slab panels 6 on the wall (FIG. 29).
9. Add the steel reinforcement to the pocket openings or where it is necessary.
10. Pour the concrete to the beam to cover the openings 95 (FIG. 30).

It will be understood that the openings 95 may not be necessary and may be replaced by steel reinforcement and concrete to the hollow core cylinders 7 in the slab panels. (The depth of the in-fill to the hollow cylindrical core 7 will generally comply with structural engineering requirements).

The advantages of a cylinder hollow core 7 in the pre-cast concrete wall and the slab panels are as follows:

1. excellent resistance to hurricane and earthquake;
2. offers optimum structural design and integrity;
3. reduced cost of heating and cooling systems;
4. reduced time in construction;
5. lower cost of construction and superior quality control;
6. excellent sound insulation;
7. simple electrical, plumbing and rain-water down pipe installation;
8. improved quality in finishes such as the corner between wall panels and floor slab panels;
9. lightness due to hollow core 7 in the panels and therefore reduces the cost of piling.

Building constructions may comprise a high rise building with mechanical and electrical (M & E) services, omitting ceiling finishes, and has the following advantages:

1. The thickness of the floor slab will be adjusted according to the M & E and structural engineering requirements. If the span of the floor slab is too long, a pre-stressing cable is introduced to the system during the process of pre-casting the concrete floor slab panels (FIGS. 31 and 31A).

2. Metal floor trunking along the floor beams to receive M & E wiring if there is any alteration work in the future. A temporary box for air conditioning ducts across the floor beam is designed to join a recess air conditioning duct 100 in the pre-cast floor slab.

3. Other services such as telephone trunking, fire fighting pipes, electrical conduits, air returns etc. can be easily inserted into the hollow cylindrical core 7 in the pre-cast floor slab.

4. Once the floor slab has been cast and joined at the positions of the floor beams and pocket openings, the small portion of ceiling completed with the layer of insulation will seal the soffit air conditioning duct. The molded timber or metal along the edges of the air conditioning duct is added in order to make the appearance of the soffit of the floor slab look like gypsum plastering.

5. Other fittings for M & E services may be fixed as desired.

The main advantage is that there is no requirement in the entire project for any ceiling finishes. The only area that may require a ceiling is the area next to an Air Heating Unit room but only for the sole purpose of better air return.

A building method embodying the invention may also incorporate columns, floor beams and pre-cast floor slabs.

| | |
|---|---|
| 1. Column | Cast-insitu concrete column composed with modular formwork. |
| 2. Floor Beam | Pre-stressing floor beam by pouring the concrete into the metal casing that had been supported by adjustable table form. |
| 3. Adjustable Table Form | Table form is a combination of two frames. Once the key-bolts are inserted, twist and the frames are locked together. The width can be adjusted to comply with the structural engineering requirements. The length can also be adjusted to suit the various spans of the floor beams without altering the table form. Two thirds of the table form will be dismantled and the remaining one third will remain until the concrete has attained the strength required. |
| 4. Pre-Cast Floor Slab | Place the pre-cast floor slab into the position that will be supported by the adjustable table form. |
| 5. | Add the steel reinforcement and pour the concrete into the metal casing formwork. The pre-cast floor slabs and pre-stressing floor beams will be tied together finally supported by the column. |

The advantages are basically that the table form is easy to erect and to dismantle. There is no waiting time as two thirds of the frames can be dismantled within a short time. Since the width and the length can be adjusted, the adjustable table form can be used for the entire project and event for the next project, therefore there is no wastage.

In summary the advantages of the method as described is that the period of completion is minimum and thus cost saving as there is no requirement for ceiling, air-conditioning ducts, formwork and waiting time. Furthermore the floor levels and central alignment (beam to beam) can be easily adjusted if necessary during the process of cast in-situ concrete.

The invention is also applicable to horizontal slidable scaffolding. Thus the 50 mm diameter opening is formed using the former 5, through the pre-cast floor slab along the edge of the building at every floor, for supporting horizontal sliding scaffolding 101 (FIGS. 33 and 33A).

The advantages are that there is no obstruction at the ground floor for the incoming cable or other services. It is also very convenient for any future maintenance to be carried out. An additional advantage is that it forms a hoarding for the respective floors by inserting the mild steel tubes to the bores.

It will also be understood that a set of parts as described herein with reference to the drawings can be used for construction in civil engineering works, such as culverts, arch-bridges, tunnels and the like, FIGS. 39 and 40 and for breakwaters in port and harbor construction (FIG. 38).

It will be further understood that in the foregoing, a release agent such as oil may be applied to the exterior surface of the parts 2, 3, 4 which may be of aluminum, so that they can be readily released from the concrete on disassembly. Alternatively, the former 5 assembled from the parts 2, 3, 4 may be enclosed in a sleeve such as a plastic e.g. P.V.C sleeve 110 FIGS. 36, 36A, which not only acts as a release agent as it is between the former 5 and the poured concrete, but also prevents poured concrete from entering the joint between the parts 2, 3, 4 so ensuring a smooth unhindered disassembly.

I claim:

1. A set of parts for use in building, comprising a plurality of separate parts which are assemblable to provide a former for defining a desired configuration in a set settable material, characterized by at least two interengageable surface forming parts (2, 3), and by a thrust part (4) which maintains the surface forming parts (2, 3) in an assembled position, and by the thrust part (4) being removable from the surface forming parts (2, 3) to allow the surface forming parts (2, 3) to be moved from the set settable material (6) whereby to leave a desired configuration (7) in that material (6).

2. A set of parts according to claim 1, characterised by the surface forming parts (2, 3) defining a curved or angular outer surface when assembled.

3. A set of parts according to claim 1, characterised by the surface forming parts (2, 3), defining a geometric shape in cross-section when assembled.

4. A set of parts according to claim 2, characterised by the surface forming parts (2, 3) defining a circle in cross-section when assembled.

5. A set of parts according to claim 2, characterised by there being four surface forming parts (2), two of which form substantially a circle when assembled, by the parts (2) having interengaging means (13) for releasable interengagement with complementary interengagement means (12) of the other two surface forming parts (3), and by the two other surface forming parts (3) being adapted to engage between facing edges of the assembled first two surface forming parts (2).

6. A set of parts according to claim 4, characterised by the complementary interengaging parts (12, 13) comprising hook-like parts.

7. A set of parts according to claim 4, characterised by the first two forming parts (2) comprising adjacent a respective edge, a guide means (14).

8. A set of parts according to claim 7, characterised by the guide means (14) each comprising a further hook-like member which are in an assembled set directed towards each other and which terminate spaced from one another whereby to provide a guide for the thrust member.

9. A set of parts according to claim 8, characterised by the thrust member (4) comprising a cylinder adapted in the assembled set to seat on the hook-like members (14) of the guide means and on a complementary surface (15, 11) of each of the other two surface forming parts (2, 3).

10. A set of parts according to claim 8, characterised by the hook-like members (14) of the guide means and the thrust member having complementary curved surfaces.

11. A set of parts according to claims 1, characterised by the thrust member comprising a frame (40) which in the assembled set of parts is located substantially centrally and which has a plurality of arms (43, 46) two of which (46) engage a respective one of the other two surface forming parts (3).

12. A set of parts according to claim 10, characterised by the two arms (46) comprising projecting spaced apart arm parts supporting at or adjacent one end an elongate nose member (49) complementary in configuration to an opposed surface of the respective one of the other two surface forming parts (3), and at the other end being pivotably connected with the frame (40).

13. A set of parts according to claim 11, characterised by the frame (40) having four arms (43, 46) arranged in a cruciform configuration about a central elongate body (41), and by the other two arms (43) being at or adjacent one end of the body (41) and having at a free end thrust members (45) for engaging the first two surface forming members (21).

14. A set of parts according to claim 11, characterised by the nose member (49) being pivotably connected with the arm parts (46) at or adjacent a free end of the respective arm parts.

15. A former (1, 40), characterised by being assembled from a set of parts according to claim 1.

* * * * *